US005212052A

United States Patent [19]

Sakanoue et al.

[11] Patent Number: 5,212,052

[45] Date of Patent: May 18, 1993

[54] SILVER HALIDE COLOR PHOTOGRAPHIC MATERIAL

[75] Inventors: Kei Sakanoue; Akira Ogawa, both of Kanagawa, Japan

[73] Assignee: Fuji Photo Film Co., Ltd., Kanagawa, Japan

[21] Appl. No.: 848,230

[22] Filed: Mar. 9, 1992

[30] Foreign Application Priority Data

Mar. 12, 1991 [JP] Japan ..... 3-70375
Apr. 26, 1991 [JP] Japan ..... 3-123073

[51] Int. Cl.[5] ..... G03C 1/46

[52] U.S. Cl. ..... 430/503; 430/505; 430/557; 430/558; 430/957

[58] Field of Search ..... 430/557, 558, 505, 957, 430/503

[56] References Cited

U.S. PATENT DOCUMENTS

| | | | |
|---|---|---|---|
| 3,725,067 | 4/1973 | Bailey et al. | 430/558 |
| 4,149,886 | 4/1979 | Tanaka et al. | 430/557 |
| 4,248,961 | 2/1981 | Hagen et al. | 430/381 |
| 4,968,594 | 11/1990 | Shimazaki et al. | 430/549 |
| 5,071,739 | 10/1991 | Ohya et al. | 430/558 |

FOREIGN PATENT DOCUMENTS

| | | |
|---|---|---|
| 169458 | 2/1987 | European Pat. Off. . |
| 320939 | 6/1989 | European Pat. Off. . |
| 447920 | 9/1991 | European Pat. Off. . |
| 1558452 | 2/1969 | France . |
| 1204680 | 9/1970 | United Kingdom . |
| 1477410 | 6/1977 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A novel silver halide color photographic material is provided comprising on a support at least one blue-sensitive layer, one green-sensitive layer and one red-sensitive layer, wherein said blue-sensitive layer comprises at least one yellow dye-forming coupler represented by the following general formula (1) and/or (2) and said green-sensitive layer comprises at least one magenta dye-forming coupler represented by the following general formula (M):

(1)

(2)

wherein $X_1$ and $X_2$ each represents an alkyl group, an aryl group or a heterocyclic group; $X_3$ represents an organic residue which forms a nitrogen-containing heterocyclic group together with >N—; Y represents an aryl group or a heterocyclic group; and Z represents a group which separates from the remainder of the molecule when the coupler undergoes a reaction with an oxidation product of a developing agent;

(M)

wherein $R_1$ and $R_2$ each represents a hydrogen atom or a substituent; and X represents a hydrogen atom or a group which separates from the remainder of the molecule when the coupler undergoes a reaction with an oxidation product of a developing agent.

22 Claims, No Drawings

SILVER HALIDE COLOR PHOTOGRAPHIC MATERIAL

FIELD OF THE INVENTION

The present invention relates to a silver halide color photographic material. More particularly, the present invention relates to a color photographic light-sensitive material comprising a novel yellow coupler and a pyrazolotriazole coupler having a specific structure.

BACKGROUND OF THE PRESENT INVENTION

In general, the formation of a dye image in a silver halide color photographic material occurs in a process wherein an aromatic primary amine color developing agent is oxidized when it reduces silver halide grains in a silver halide color photographic material which has been exposed to light, and the resulting oxidation product undergoes a coupling reaction with a coupler contained in the silver halide color photographic material. In the formation of a dye image in a silver halide color photographic material, the subtractive color process is used to provide color reproduction. Therefore, three kinds of couplers which form yellow, magenta and cyan dyes, respectively, are normally used.

Among these couplers, as yellow couplers there are generally known acylacetanilide type couplers containing an active methylene (methine) group as disclosed in T. H. James, "The Theory of the Photographic Process", 4th ed., page 354. These couplers are disadvantageous in that they exhibit a low absorptivity coefficient, a poor dye image preservability, especially in a dark place, and a broad spectral absorption causing poor color reproducibility, etc.

As couplers similar to the yellow couplers of the present invention there are known malondianilide yellow couplers as disclosed in U.S. Pat. Nos. 4,149,886, 4,095,984, and 4,477,563, and British Patent 1,204,680. However, these couplers are disadvantageous in that they exhibit an even lower dye image preservability. These couplers are disadvantageous in that they exhibit a broad spectral absorption having a trailing skirt on the long wavelength side, causing some difficulties in color reproducibility.

With respect to magenta couplers, the improvement in the hue of the magenta dye by the use of pyrazoloazole magenta couplers instead of 5-pyrazolone type couplers which had been commonly used has been recently noted. Dyes produced by the reaction of these couplers with an oxidation product of a color developing agent exhibit little side absorption harmful in color reproduction, making it possible to widen the color reproducible range. These couplers are described in U.S. Pat. Nos. 3,725,067, and 4,942,117, and JP-A-60-172982, JP-A-63-231347, and JP-A-63-291058 (the term "JP-A" as used herein means an "unexamined published Japanese patent application"). These couplers are excellent in image preservability in a dark place as compared to conventional pyrazolone type couplers.

However, the combination of the conventional yellow couplers with these pyrazoloazole magenta couplers can provide some improvement in the magenta image preservability in a dark place, but this combination exhibits a poor yellow image preservability in a dark place, causing a poor balance therebetween in practice. Furthermore, the examination of discoloration behavior on a portion where only yellow has been developed revealed a new problem that as the yellow image discolors, the yellow portion is stained with magenta.

SUMMARY OF THE INVENTION

It is therefore an object of the present invention to provide a silver halide color photographic material which exhibits a good discoloration balance between the yellow image and the magenta image and further provides an improved color image preservability in practice when a pyrazolotriazole coupler is used.

It is another object of the present invention to provide a silver halide photographic material which provides some improvement in the inhibition of magenta stain caused by the discoloration of the yellow portion when a pyrazolotriazole coupler is used.

These and other objects of the present invention will become more apparent from the following detailed description and examples.

As a result of extensive studies, the inventors found that these objects of the present invention are accomplished with a silver halide color photographic material comprising on a support at least one blue-sensitive layer, one green-sensitive layer and one red-sensitive layer, wherein said blue-sensitive layer comprises at least one yellow dye-forming coupler represented by the following general formulae (1) and/or (2) and said green-sensitive layer comprises at least one magenta dye-forming coupler represented by the following general formula (M):

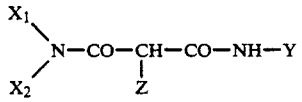

(1)

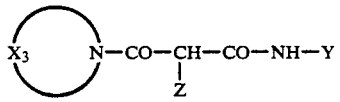

(2)

wherein $X_1$ and $X_2$ each represents an alkyl group, an aryl group or a heterocyclic group; $X_3$ represents an organic residue which forms a nitrogen-containing heterocyclic group together with >N—; Y represents an aryl group or a heterocyclic group; and Z represents a group which separates from the remainder of the molecule when the coupler undergoes a reaction with an oxidation product of a developing agent;

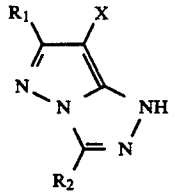

(M)

wherein $R_1$ and $R_2$ each represents a hydrogen atom or a substituent; and X represents a hydrogen atom or a group which separates from the remainder of the molecule when the coupler undergoes a reaction with an oxidation product of a developing agent.

DETAILED DESCRIPTION OF THE INVENTION

The general formulae (1) and (2) of the present invention will be further described hereinafter.

Firstly, the couplers represented by the general formulae (1) and (2) will be further described.

The alkyl group represented by $X_1$ or $X_2$ is a $C_{1-30}$, preferably $C_{1-20}$ straight-chain, branched or cyclic, saturated or unsaturated, substituted or unsubstituted alkyl group. Examples of such an alkyl group include methyl, ethyl, propyl, butyl, cyclopropyl, allyl, t-octyl, i-butyl, dodecyl, and 2-hexyldecyl.

The heterocyclic group represented by $X_1$ or $X_2$ is a $C_{1-20}$, preferably $C_{1-10}$ 3- to 12-membered, preferably 5- or 6-membered, saturated or unsaturated, substituted or unsubstituted, monocyclic or condensed heterocyclic group containing at least one nitrogen atom, oxygen atom or sulfur atom as a hetero atom. Examples of such a heterocyclic group include 3-pyrolidinyl, 1,2,4- triazole-3-il, 2-pyridyl, 4-pyrimidinyl, 3-pyrazolyl, 2-pyrrolyl, 2,4-ioxo-1,3-imidazolidine-5-il or pyranyl.

The aryl group represented by $X_1$ or $X_2$ is a $C_{6-20}$, preferably $C_{6-10}$ substituted or unsubstituted aryl group. Typical examples of such an aryl group include phenyl, and naphthyl.

The nitrogen-containing heterocyclic group represented by $X_3$ together with >N— is a $C_{1-20}$, preferably $C_{1-15}$ 3- to 12-membered, preferably 5- or 6-membered substituted or unsubstituted, saturated or unsaturated, monocyclic or condensed heterocyclic group which may contain an oxygen atom or a sulfur atom besides a nitrogen atom as a hetero atom. Examples of such a heterocyclic group include pyrrolidino, piperidino, morpholino, 1-piperadinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-s,s-dioxo-4-yl, and benzoxazine-4-yl.

When $X_1$ and $X_2$ each represents a substituted alkyl, aryl or heterocyclic group and $X_3$ forms a substituted nitrogen-containing heterocyclic group together with >N—, examples of substituents contained therein include a halogen atom (e.g., fluorine, chlorine), an alkoxycarbonyl group ($C_{2-30}$, preferably $C_{2-20}$ alkoxycarbonyl group, e.g., methoxycarbonyl, dodecyloxycarbonyl, hexadecyloxycarbonyl), an acylamino group ($C_{2-30}$, preferably $C_{2-20}$ acylamino group, e.g., acetamide, tetradecanamide, 2-(2,4-di-t-amylphenoxy)butanamide, benzamide), a sulfonamide group ($C_{1-30}$, preferably $C_{1-20}$ sulfonamide group, e.g., methanesulfonamide, dodecanesulfonamide, hexadecylsulfonamide, benzenesulfonamide), a carbamoyl group ($C_{1-30}$, preferably $C_{1-20}$ carbamoyl group, e.g., N-butylcarbamoyl, N,N-diethylcarbamoyl), an N-sulfonylcarbamoyl group ($C_{1-30}$, preferably $C_{1-20}$ N-sulfonylcarbamoyl group, e.g., N-mesylcarbamoyl, N-dodecylsulfonylcarbamoyl), a sulfamoyl group ($C_{1-30}$, preferably $C_{1-20}$ sulfamoyl group, e.g., N-butylsulfamoyl, N-dodecylsulfamoyl, N-hexadecylsulfamoyl, N-3-(2,4-di-t-amylphenoxy)-butylsulfamoyl, N,N-diethyl-sulfamoyl), an alkoxy group ($C_{1-30}$, preferably $C_{1-20}$ alkoxy group, e.g., methoxy, hexadecyloxy, isopropoxy), an aryloxy group ($C_{6-20}$, preferably $C_{6-10}$ aryloxy group, e.g., phenoxy, 4-methoxyphenoxy, 3-t-butyl-4-hydroxyphenoxy, naphthoxy), an aryloxycarbonyl group ($C_{7-21}$, preferably $C_{7-11}$ aryloxycarbonyl group, e.g., phenoxycarbonyl), an N-acylsulfamoyl group ($C_{2-30}$, preferably $C_{2-20}$ N-propanoylsulfamoyl, N-tetradecanoylsulfamoyl), a sulfonyl group ($C_{1-30}$, preferably $C_{1-20}$ sulfonyl group, e.g., methanesulfonyl, octanesulfonyl, 4-hydroxyphenylsulfonyl, dodecanesulfonyl), an alkoxycarbonylamino group ($C_{1-30}$, preferably $C_{1-20}$ alkoxycarbonylamino group, e.g., ethoxycarbonylamino), a cyano group, a nitro group, a carboxyl group, a hydroxyl group, a sulfo group, an alkylthio group ($C_{1-30}$, preferably $C_{1-20}$ alkylthio group, e.g., methylthio, dodecylthio, dodecylcarbamoylmethylthio), a ureido group ($C_{1-30}$, preferably $C_{1-20}$ ureido group, e.g., N-phenylureido, N-hexadecylureido), an aryl group ($C_{6-20}$, preferably $C_{6-10}$ aryl group, e.g., phenyl, naphthyl, 4-methoxyphenyl), a heterocyclic group ($C_{1-20}$, preferably $C_{1-10}$ heterocyclic group, e.g., 3- to 12-membered, preferably 5- or 6-membered, monocyclic or condensed heterocyclic group containing at least one nitrogen, oxygen or sulfur atom as a hetero atom, such as 2-pyridyl, 3-pyrazolyl, 1-pyrrolyl, 2,4-dioxo-1,3-imidazolidine-1-yl, 2-benzoxazolyl, morpholino, indolyl), an alkyl group ($C_{1-30}$, preferably $C_{1-20}$ straight-chain, branched or cyclic, saturated or unsaturated alkyl group, e.g., methyl, ethyl, isopropyl, cyclopropyl, t-pentyl, t-octyl, cyclopentyl, t-butyl, s-butyl, dodecyl, 2-hexyldecyl), an acyl group ($C_{1-30}$, preferably $C_{2-20}$ acyl group, e.g., acetyl, benzoyl), an acyloxy group ($C_{2-30}$, preferably $C_{2-20}$ acyloxy group, e.g , propanoyloxy, tetradecanoyloxy), an arylthio group ($C_{6-20}$, preferably $C_{6-10}$ arylthio group, e.g., phenylthio, naphthylthio), a sulfamoylamino group ($C_{0-30}$, preferably $C_{0-20}$ sulfamoylamino group, e.g., N-butylsulfamoylamino, N-dodecylsulfamoylamino, N-phenylsulfamoylamino), and an N-sulfonylsulfamoyl group ($C_{1-30}$, preferably $C_{1-20}$ N-sulfonylsulfamoyl group, e.g., N-mesylsulfamoyl, N-ethanesulfonylsulfamoyl, N-dodecanesulfonylsulfamoyl, N-hexadecanesulfonylsulfamoyl). These substituents may further contain substituents. Examples of such substituents include those substituents described above.

Preferred among these substituents are an alkoxy group, a halogen atom, an alkoxycarbonyl group, an acyloxy group, an acylamino group, a sulfonyl group, a carbamoyl group, a sulfamoyl group, a sulfonamide group, a nitro group, an alkyl group, and an aryl group.

In the general formulae (1) and (2), the aryl group represented by Y is a $C_{6-20}$, preferably $C_{6-10}$ substituted or unsubstituted aryl group. Typical examples of such an aryl group include a phenyl group and a naphthyl group.

The heterocyclic group represented by Y in the general formulae (I) and (II) has the same meaning as defined with reference to $X_1$ or $X_2$.

When Y represents a substituted aryl group or a substituted heterocyclic group, examples of substituents to be contained therein include those described with reference to $X_1$. In a preferred example, one of the substituents contained in the substituted aryl group or substituted heterocyclic group represented by Y is a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamide group or an alkyl group.

A particularly preferred example of Y is a phenyl group containing at least one substituent in the ortho position.

In the general formulae (1) and (2), the group represented by Z may be any known coupling-separatable group. Preferred examples of such a group include a nitrogen-containing heterocyclic group which is connected to the coupling position via a nitrogen atom, an aryloxy group, an arylthio group, a heterocyclic oxy group, a heterocyclic thio group, an acyloxy group, a carbamoyloxy group, an alkylthio group, and a halogen atom.

Such a separatable group may be either a nonphotographically useful group or a photographically useful group or a precursor thereof (e.g., development inhibitor, development accelerator, desilvering accelerator, fogging agent, dye, film hardener, coupler, scavenger of oxidation product of developing agent, fluorescent dye, developing agent, electron transfer agent).

As photographically useful groups represented by Z there can preferably be used those groups that are commonly known. Examples of such photographically useful groups include those disclosed in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, and 4,741,994, and European Patent Disclosure Nos. 193389A, 348139A and 272573A and separatable groups (e.g., timing group) for releasing these photographically useful groups.

When Z represents a nitrogen-containing heterocyclic group which is bonded to the coupling position via the nitrogen atom, it is preferably a $C_{1-15}$, more preferably $C_{1-10}$, 5- or 6-membered, substituted or unsubstituted, saturated or unsaturated, monocyclic or condensed heterocyclic group. The heterocyclic group may contain an oxygen atom or a sulfur atom besides a nitrogen atom as a hetero atom. Specific preferred examples of such a heterocyclic group include 1-pyrazolyl, 1-imidazolyl, pyrrolino, 1,2,4-triazole-2-yl, 1,2,3-triazole-3-yl, benzotriazolyl, benzimidazolyl, imidazolidine-2,4-dione-3-yl, oxazolidine-2,4-dione-3-yl, 1,2,4-triazolidine-3,5-dione-4-yl, imidazolidine-2,4,5-trione-3-yl, 2-imidazolinone-1-yl, 3,5-dioxomorpholino, and 1-indazolyl. When these heterocyclic groups contain substituents, examples of these substituents include those described as substituents which may be contained in the group represented by $X_1$. Preferably, one of these substituents is an alkyl group, an alkoxy group, a halogen atom, an alkoxycarbonyl group, an aryloxycarbonyl group, an alkylthio group, an acylamino group, a sulfonamide group, an aryl group, a nitro group, a carbamoyl group a cyano group or a sulfonyl group.

When Z represents an aromatic oxy group, it is preferably a $C_{6-10}$ substituted or unsubstituted aromatic oxy group, particularly a substituted or unsubstituted phenoxy group. When the aromatic oxy group represented by Z contains substituents, examples of such substituents include those described as substituents which may be contained in the group represented by $X_1$. Preferably, at least one of these substituents is an electrophilic substituent. Examples of such an electrophilic substituent include a sulfonyl group, an alkoxycarbonyl group, a sulfamoyl group, a halogen atom, a carbamoyl group, a nitro group, a cyano group, and an acyl group.

When Z represents an aromatic thio group, it is preferably a $C_{6-10}$ substituted or unsubstituted aromatic thio group, particularly a substituted or unsubstituted phenylthio group. When the aromatic thio group represented by Z contains substituents, examples of such substituents include those described as substituents which may be contained in the group represented by $X_1$. Preferably, at least one of these substituents is an alkyl group, an alkoxy group, a sulfonyl group, an alkoxycarbonyl group, a sulfamoyl group, a halogen atom, a carbamoyl group or a nitro group.

When Z represents a heterocyclic oxy group, the heterocyclic group portion thereof is a $C_{1-20}$, preferably $C_{1-10}$, 3- to 12-membered, preferably 5- or 6-membered, substituted or unsubstituted, saturated or unsaturated, monocyclic or condensed heterocyclic group containing at least one nitrogen atom, oxygen atom or sulfur atom as a hetero atom. Examples of such a heterocyclic oxy group include a pyridyloxy group, a pyrazolyloxy group, and a furyloxy group. When the heterocyclic oxy group represented by Z contains substituents, examples of such substituents include those described as substituents which may be contained in the group represented by $X_1$. Preferably, one of these substituents is an alkyl group, an aryl group, a carboxyl group, an alkoxy group, a halogen atom, an alkoxycarbonyl group, an aryloxycarbonyl group, an alkylthio group, an acylamino group, a sulfonamide group, a nitro group, a carbamoyl group or a sulfonyl group.

When Z represents a heterocyclic thio group, the heterocyclic group portion thereof is a $C_{1-20}$, preferably $C_{1-10}$, 3- to 12-membered, preferably 5- or 6-membered, substituted or unsubstituted, saturated or unsaturated, monocyclic or condensed heterocyclic group containing at least one nitrogen atom, oxygen atom or sulfur atom as a hetero atom. Examples of such a heterocyclic thio group include a tetrazolylthio group, a 1,3,4-thiadiazolylthio group, a 1,3,4-oxadiazolylthio group, a 1,3,4-triazolylthio group, a benzoimidazolylthio group, a benzothiazolylthio group, and a 2-pyridylthio group. When the heterocyclic thio group represented by Z contains substituents, examples of such substituents include those described as substituents which may be contained in the group represented by $X_1$. Preferably, one of these substituents is an alkyl group, an aryl group, a carboxyl group, an alkoxy group, a halogen atom, an alkoxycarbonyl group, an aryloxycarbonyl group, an alkylthio group, an acylamino group, a sulfonamide group, a nitro group, a carbamoyl group, a heterocyclic group or a sulfonyl group.

When Z represents an acyloxy group, it is preferably a $C_{6-10}$, monocyclic or condensed, substituted or unsubstituted aromatic acyloxy group or $C_{2-30}$, preferably $C_{2-20}$ substituted or unsubstituted aliphatic acyloxy group. When the aromatic or aliphatic acyloxy group represented by Z contains substituents, examples of such substituents include those described as substituents which may be contained in the group represented by $X_1$.

When Z represents a carbamoyloxy group, it is a $C_{1-30}$, preferably $C_{1-20}$ aliphatic, aromatic or heterocyclic substituted or unsubstituted carbamoyloxy group. Examples of such a carbamoyloxy group include N,N-diethylcarbamoyloxy, N-phenylcarbamoyloxy, 1-imidazolylcarbonyloxy, and 1-pyrrolocarbonyloxy. When the carbamoyloxy group represented by Z contains substituents, examples of such substituents include those described as substituents which may be contained in the group represented by $X_1$.

When Z represents an alkylthio group, it is a $C_{1-30}$, preferably $C_{1-20}$, straight-chain, branched or cyclic, saturated or unsaturated, substituted or unsubstituted alkylthio group. When the alkylthio group represented by Z contains substituents, examples of such substituents include those described as substituents which may be contained in the group represented by $X_1$.

Particularly preferred ranges of the couplers represented by the general formulae (1) and (2) will be described hereinafter.

In the general formula (1), the group represented by $X_1$ is preferably an alkyl group, particularly a $C_{1-10}$ alkyl group.

In the general formulae (1) and (2), the group represented by Y is preferably an aromatic group, particularly a phenyl group containing at least one substituent in the ortho position. Examples of such a substituent include those described as substituents which may be contained in the aromatic group represented by Y. Similarly, preferred examples of such a substituent include those described as preferred substituents which may be contained in the aromatic group represented by Y.

In the general formulae (1) and (2), the group represented by Z is preferably a 5- or 6-membered nitrogen-containing heterocyclic group which is bonded to the coupling position via the nitrogen atom, an aromatic oxy group, a 5- or 6-membered heterocyclic oxy group or a 5- or 6-membered heterocyclic thio group.

Preferred examples of the couplers represented by the general formulae (1) and (2) are represented by the following general formulae (3), (4) and (5):

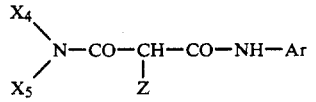
(3)

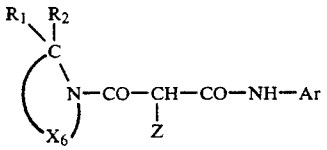
(4)

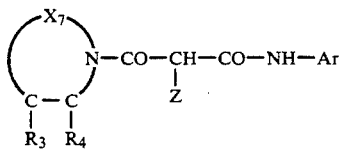
(5)

wherein Z is as defined in the general formula (1); $X_4$ represents an alkyl group; $X_5$ represents an alkyl group or an aromatic group; Ar represents a phenyl group containing at least one substituent in the ortho position thereof; $X_6$ represents an organic residue which forms a nitrogen-containing heterocyclic group (monocyclic or condensed) together with $—C(R_1R_2)—N<$; $X_7$ represents an organic residue which forms a nitrogen-containing heterocyclic group (monocyclic or condensed) together with $—C(R_3)=C(R_4)—N<$; and $R_1$, $R_2$, $R_3$ and $R_4$ each represents a hydrogen atom or a substituent.

In the general formulae (3) to (5), the detailed description and preferred ranges of the groups represented by $X_4$ to $X_7$, Ar and Z are the same as those given with reference to the general formulae (1) and (2). When $R_1$ to $R_4$ represent substituents, examples of such substituents include those described as substituents which may be contained in the group represented by $X_1$.

Particularly preferred among the couplers represented by the general formulae (3), (4) and (5) are those represented by the general formulae (4) and (5).

The couplers represented by the general formulae (1) to (5) may form a dimer or higher polymer (e.g., telomer or polymer) connected via a group having a valency or 2 or more to the group represented by $X_1$ to $X_7$, Y, Ar, $R_1$ to $R_4$, or Z. In this case, the number of carbon atoms contained in the substituents may deviate from the range as defined above. The formation of such a dimer or higher polymer of the couplers can be conducted by utilizing methods disclosed in U.S. Pat. No. 4,576,910 and JP-A-60-220346.

The couplers represented by the general formulae (1) to (5) are preferably nondiffusive couplers. The term "nondiffusive coupler" as used herein means a "coupler which contains in its molecule a group that gives a molecular weight high enough to immobilize the molecule in a layer in which it has been incorporated". In general, a $C_{8-30}$, preferably $C_{10-20}$ alkyl group or $C_{4-20}$ substituted aryl group is used. Such a nondiffusive group may substituted in any portion of the molecule. There may also be contained a plurality of such nondiffusive groups in the molecule.

Specific examples of the couplers represented by the general formulae (1) to (5) will be set forth below, but the present invention should not be construed as being limited thereto.

Y-1

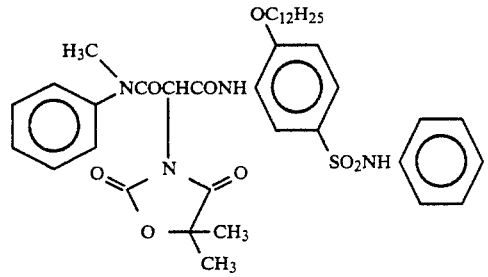

Y-2

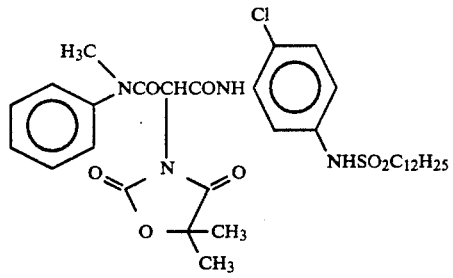

Y-3

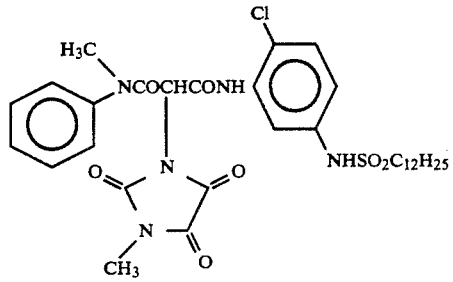

-continued
Y-4
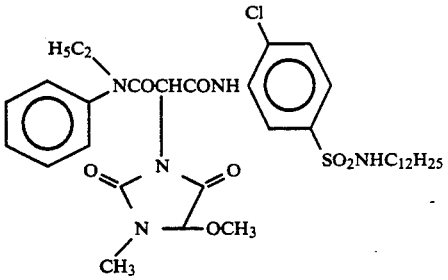
Y-5
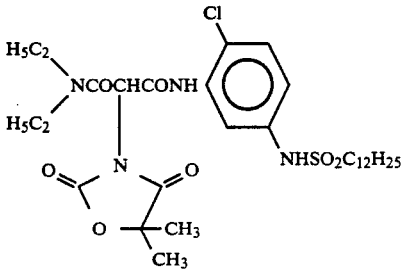
Y-6
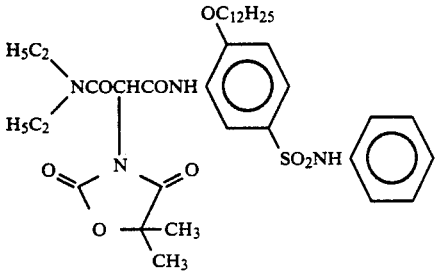
Y-7
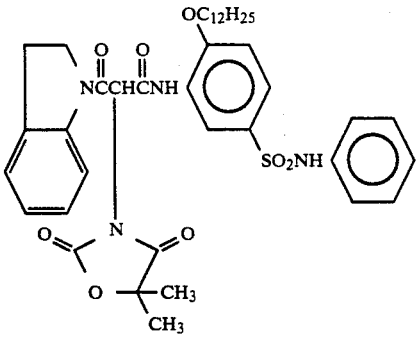
Y-8
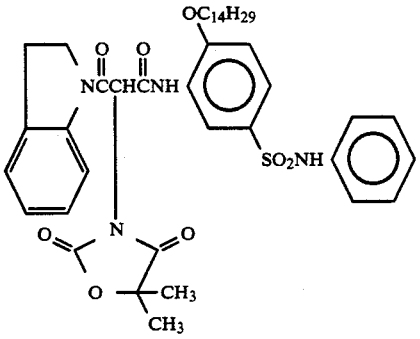
-continued
Y-9
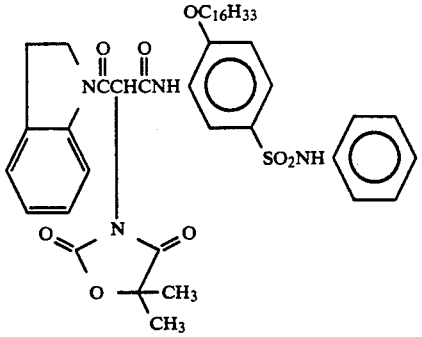
Y-10
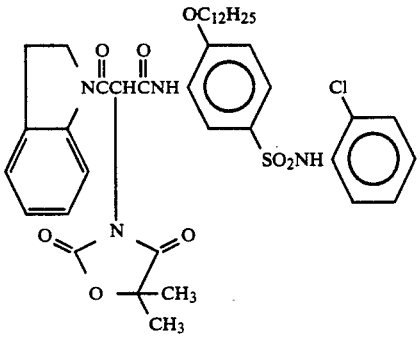
Y-11
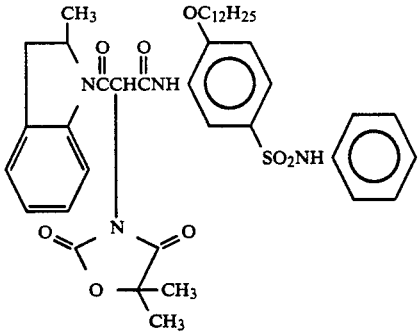
Y-12
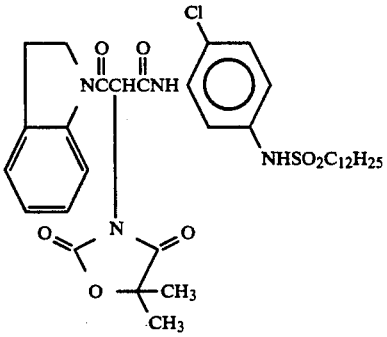

-continued
Y-13
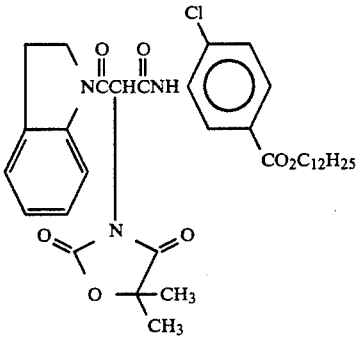
Y-14
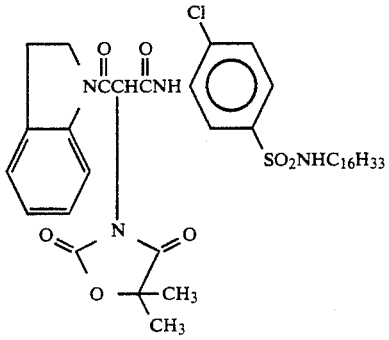
Y-15
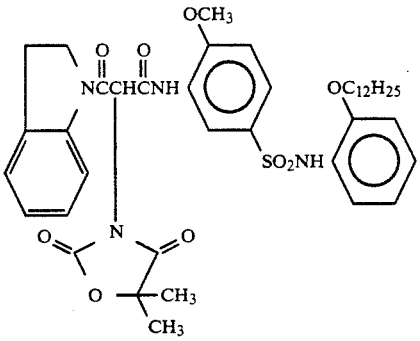
Y-16
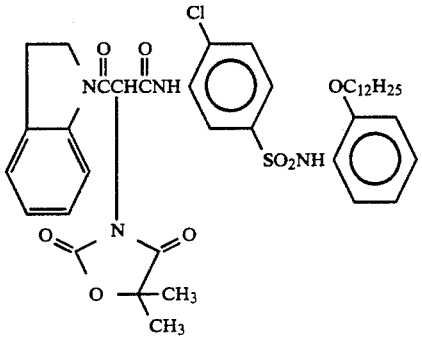
-continued
Y-17
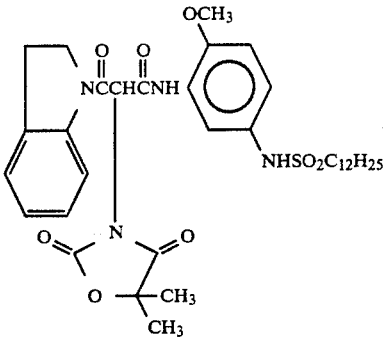
Y-18
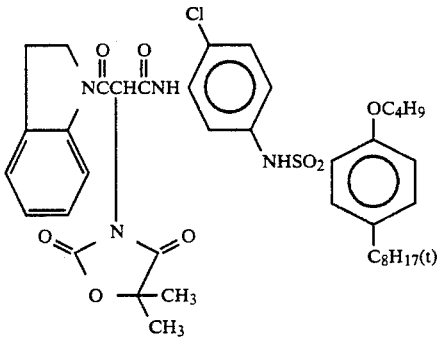
Y-19
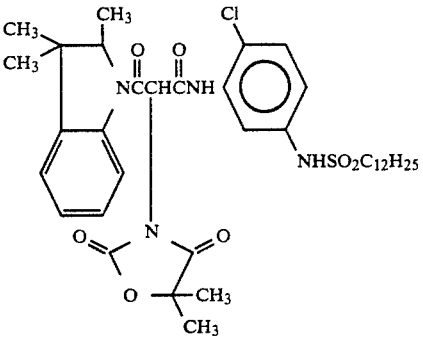
Y-20
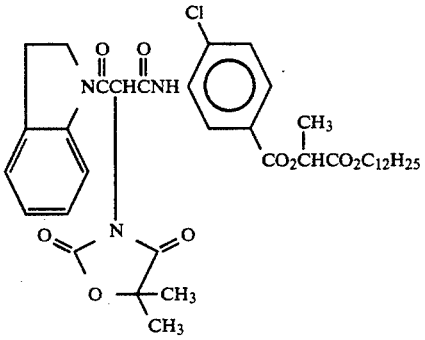

-continued
Y-21
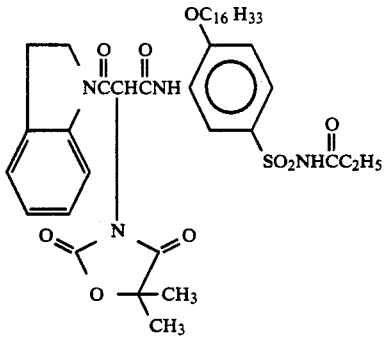
Y-22
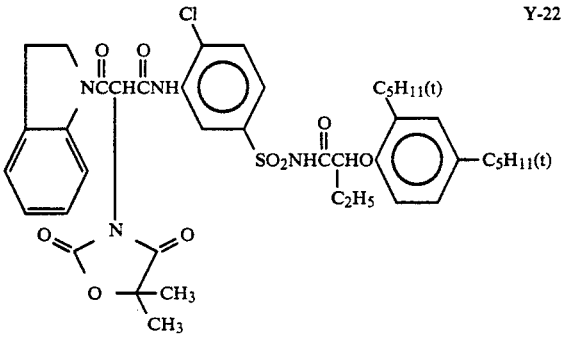
Y-23
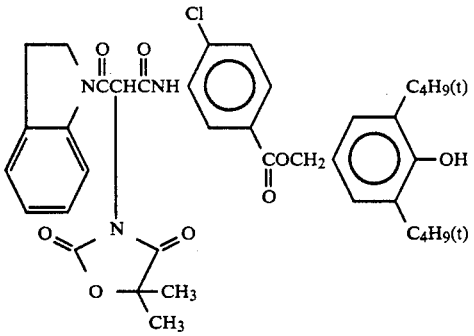
Y-24
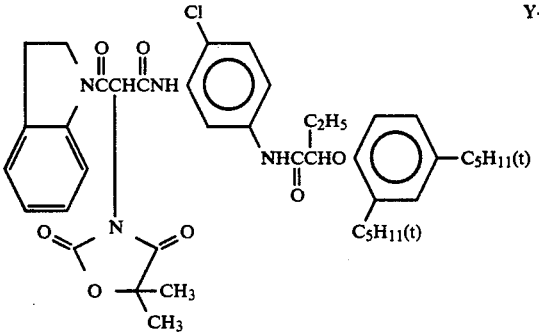
-continued
Y-25
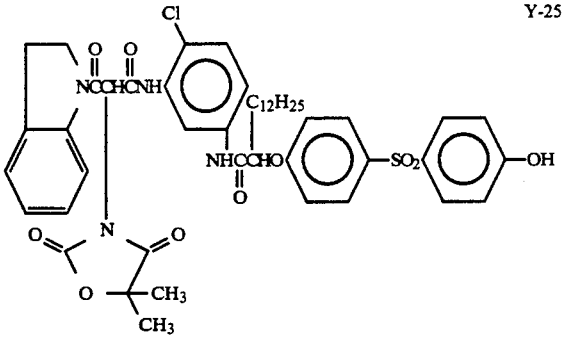
Y-26
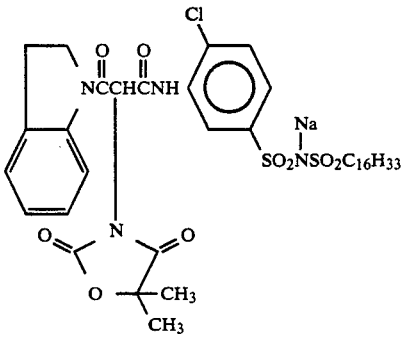
Y-27
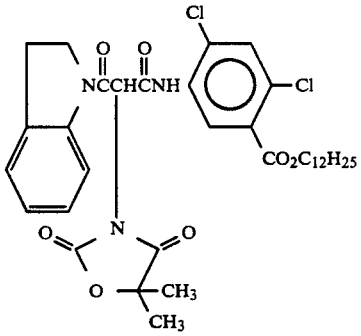
Y-28
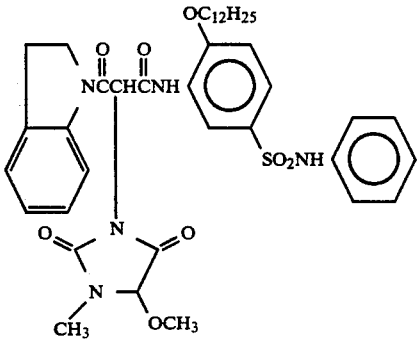

-continued
Y-29
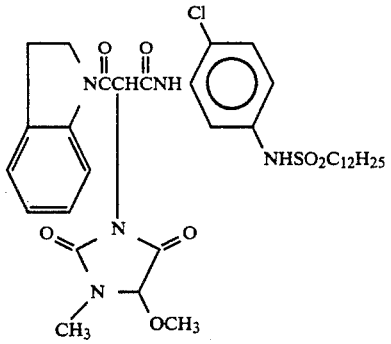
Y-30
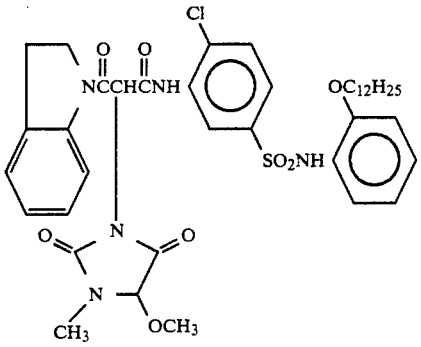
Y-31
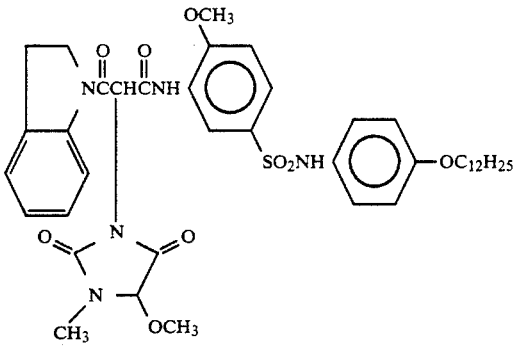
Y-32
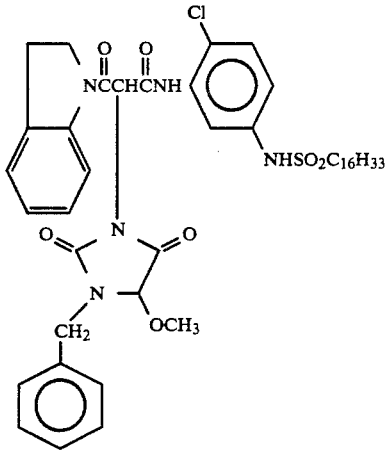
-continued
Y-33
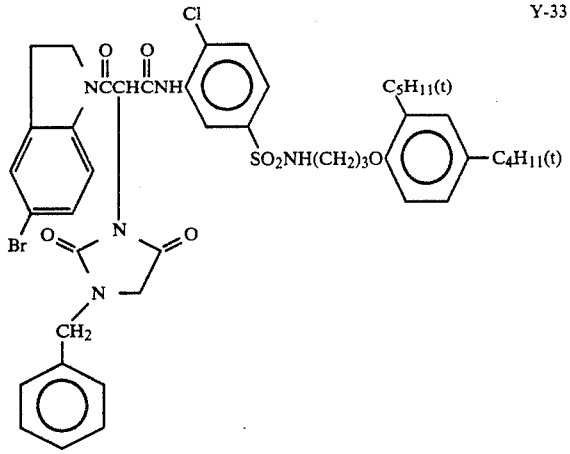
Y-34
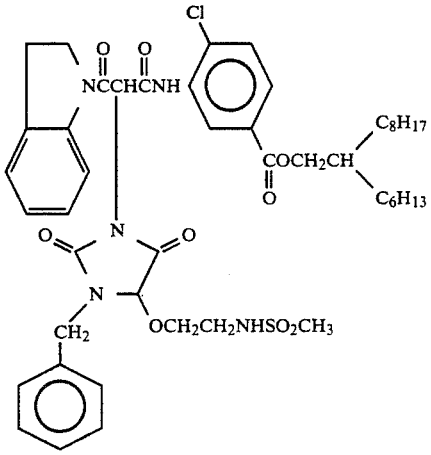
Y-35
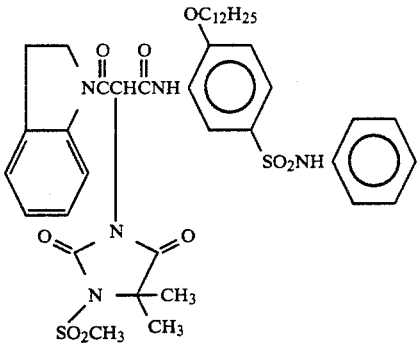
Y-36
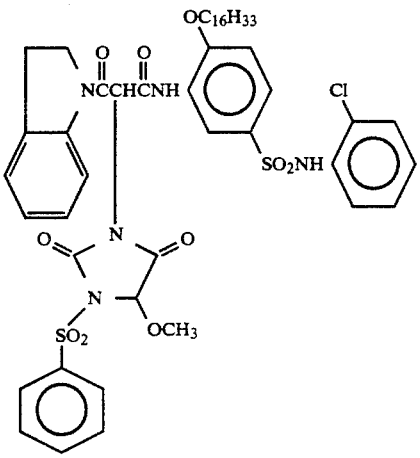

-continued
Y-37
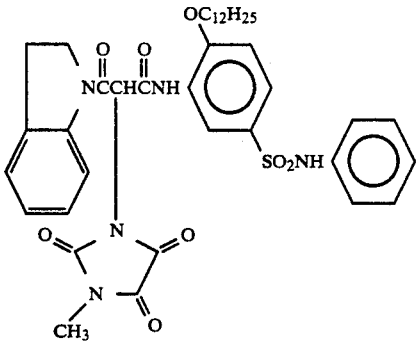
Y-38
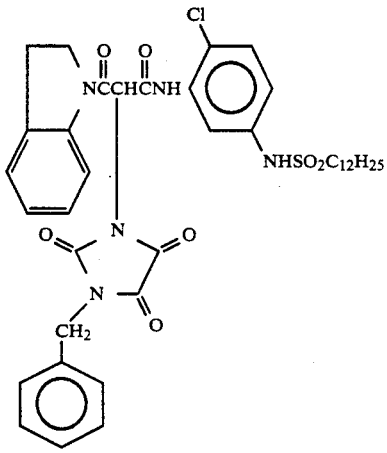
Y-39
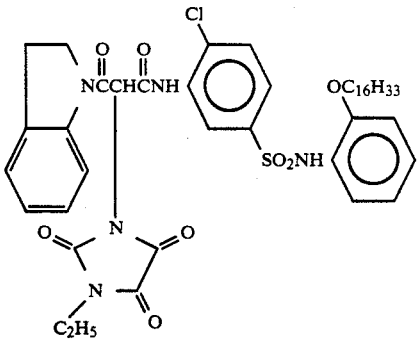
Y-40
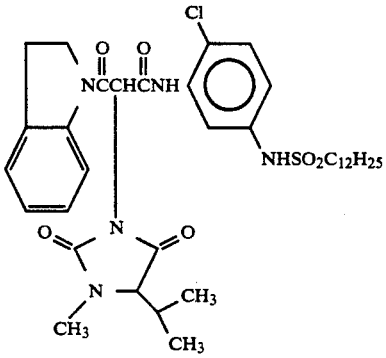
-continued
Y-41
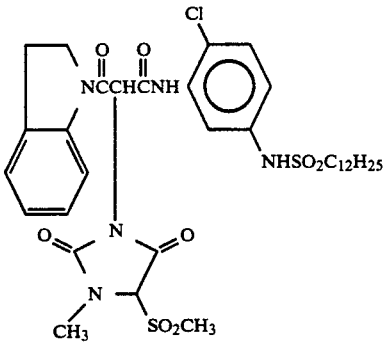
Y-42
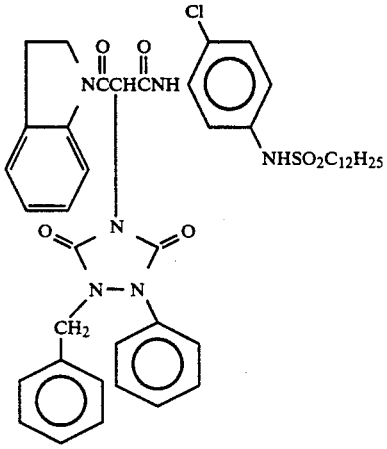
Y-43
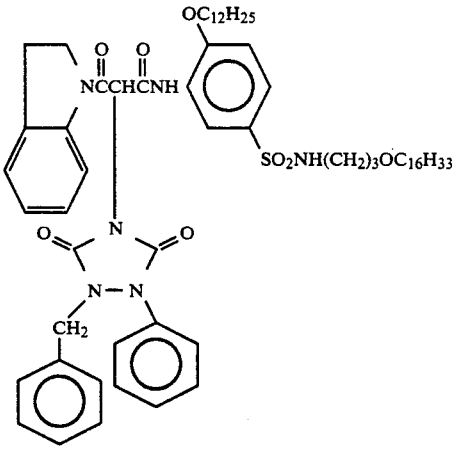
Y-44
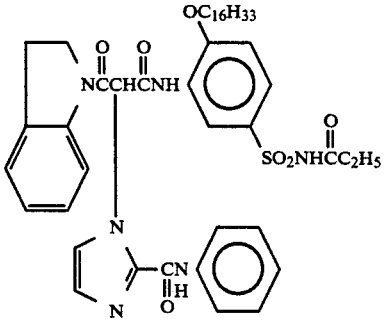

-continued
Y-45
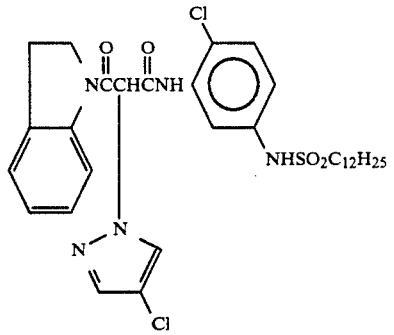
Y-46
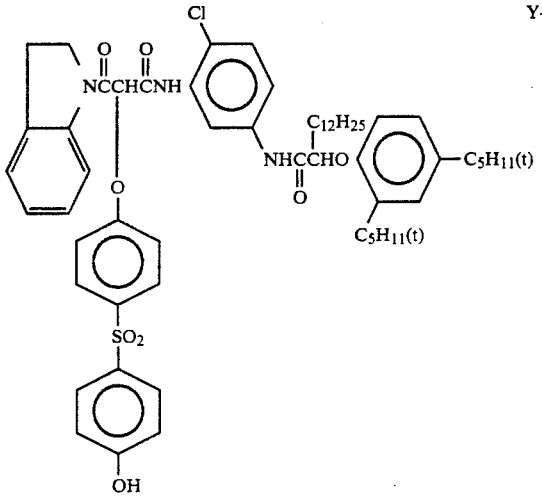
Y-47
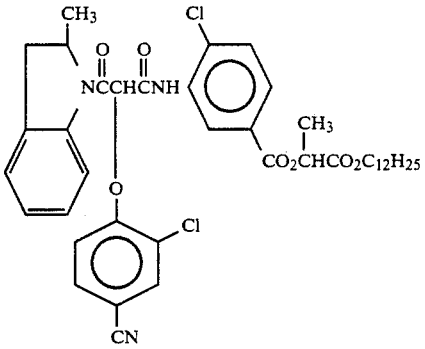
Y-48
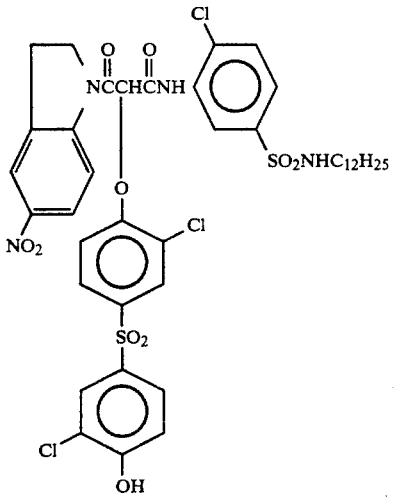
-continued
Y-49
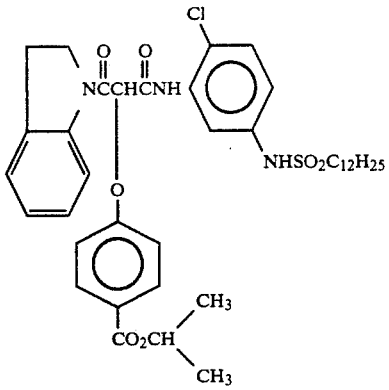
Y-50
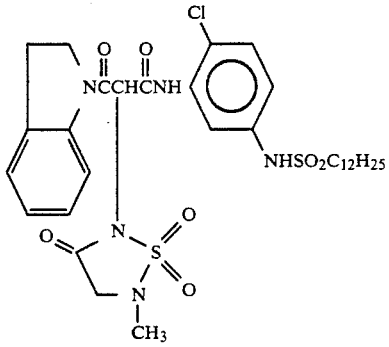
Y-51
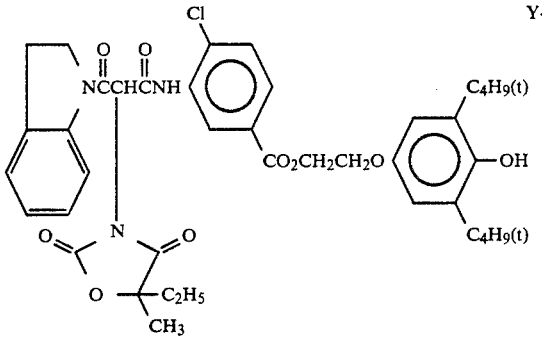
Y-52
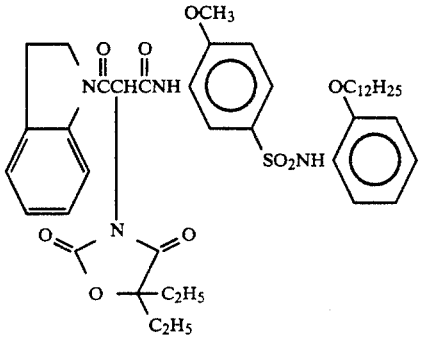

-continued
Y-53
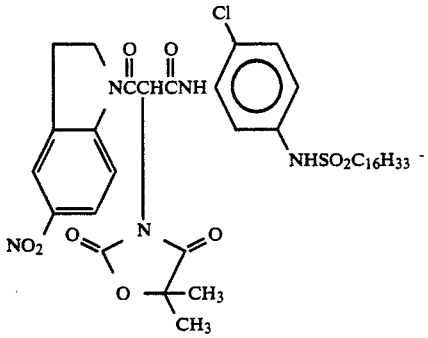
Y-54
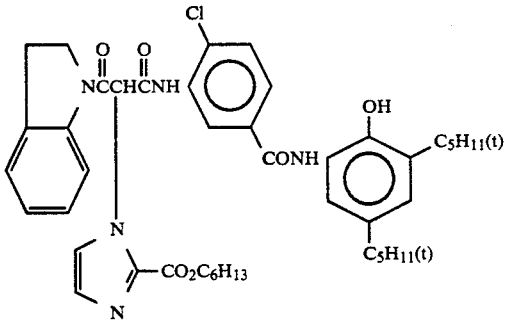
Y-55
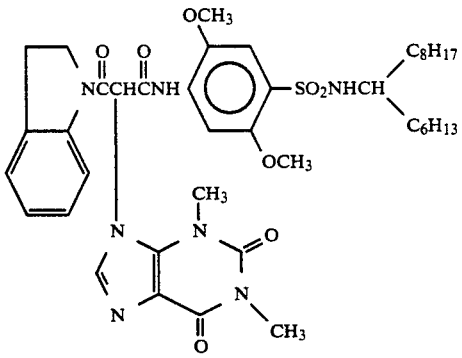
Y-56
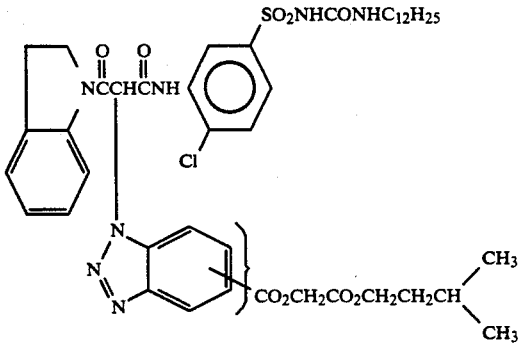
-continued
Y-57
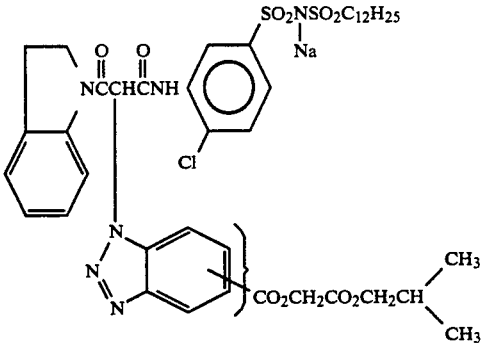
Y-58
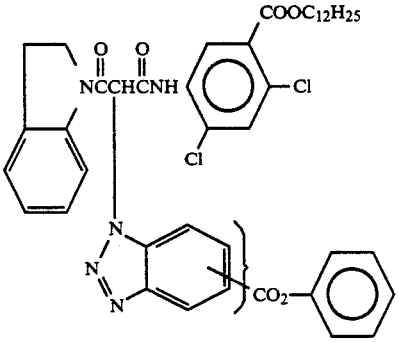
Y-59
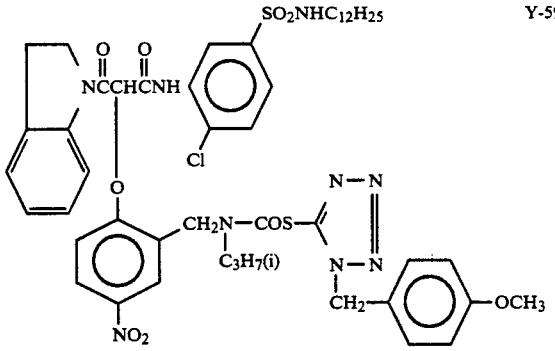
Y-60
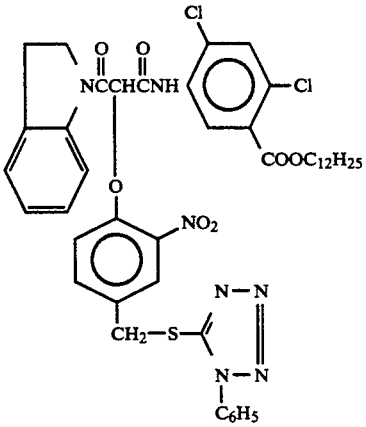

-continued

Y-61

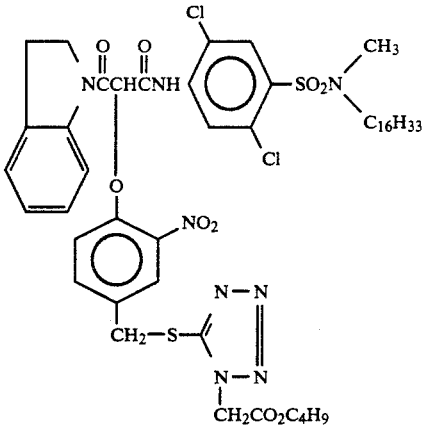

Y-62

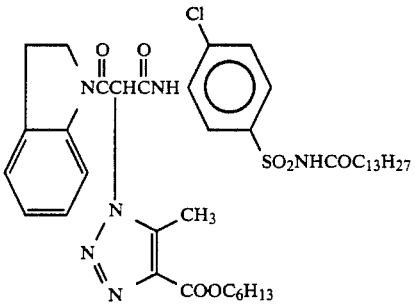

The synthesis of the yellow couplers of the present invention represented by the general formulae (1) to (5) can be accomplished by the following processes:

SYNTHESIS EXAMPLE 1

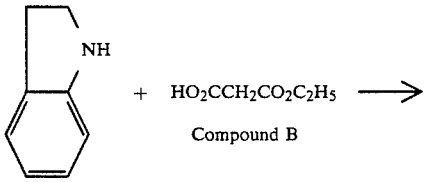

Compound A

Compound B

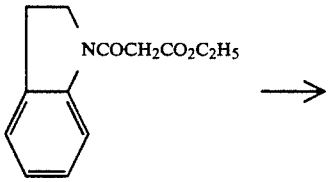

Intermediate A

-continued

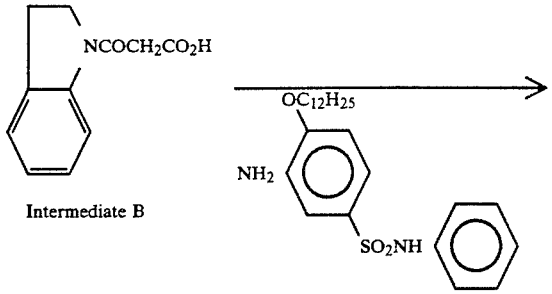

Intermediate B

Compound C

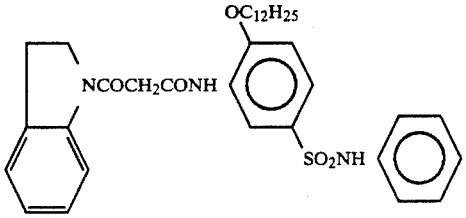

Intermediate D

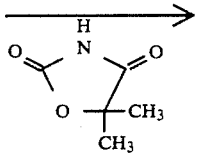

Compound D

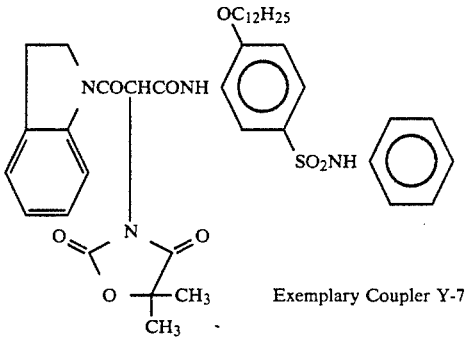

Exemplary Coupler Y-7

Synthesis of Intermediate B 357.5 g (3.0 mol) of Compound A and 396.3 g (3.0 mol) of Compound B were dissolved in 1.2 l of ethyl acetate and 0.61 l of dimethyl formamide. A solution of 631 g (3.06 mol) of dicyclohexyl carbodiimide in 400 ml of acetonitrile was added dropwise to the solution while stirring at a temperature of 15° to 35° C. The reaction system was then allowed to undergo reaction at a temperature of 20° to 30° C. for 2 hours. The resulting dicyclohexyl urea was filtered off. To the filtrate were added 500 ml of ethyl acetate and 1 l of water. The aqueous phase was removed. The organic phase was twice washed with 1 l of water. The organic phase was dried with anhydrous sodium sulfate. Ethyl acetate was distilled off under reduced pressure. As a result, 692 g (yield: 98.9%) of Intermediate A was obtained in the form of oily matter.

692 g (2.97 mol) of Intermediate A was dissolved in 3 l of ethyl alcohol. 430 g of a 30% sodium hydroxide solution was added dropwise to the solution while stirring at a temperature of 75° to 80° C. After the dropwise addition, the reaction system was allowed to undergo reaction at the same temperature for 30 minutes. The resulting crystal was removed. (Yield: 658 g).

The thus obtained crystal was suspended in 5 l of water. 300 ml of concentrated hydrochloric acid was added dropwise to the suspension while stirring at a temperature of 40° to 50° C. The reaction system was further stirred at the same temperature for 1 hour. The resulting crystal was removed. As a result, 579 g (yield: 95%) was obtained. (Decomposition point: 127° C.)

Synthesis of Intermediate D 45.1 g (0.22 mol) of Intermediate B and 86.6 g (0.2 mol) of Compound C were dissolved in 400 ml of ethyl acetate and 200 ml of dimethyl acetamide. A solution of 66 g (0.32 mol) of dicyclohexyl carbodiimide in 100 ml of acetonitrile was added dropwise to the solution while stirring at a temperature of 15° to 35° C. The reaction system was then allowed to undergo reaction at a temperature of 20° to 30° C. for 2 hours. The resulting dicyclohexyl urea was filtered off.

To the filtrate were added 400 ml of ethyl acetate and 600 ml of water. The aqueous phase was removed. The organic phase was twice washed with water. The organic phase was dried with anhydrous sodium sulfate. Ethyl acetate was distilled off under reduced pressure. As a result, 162 g of an oily matter was obtained.

The oily matter was crystallized from 100 ml of ethyl acetate and 300 ml of n-hexane to obtain 108 g (yield: 87.1%) of Intermediate D. (Melting point: 132° to 134° C.).

TABLE 1

| Elemental analysis of Intermediate D | C | H | N |
|---|---|---|---|
| Calculated % | 67.82 | 7.32 | 6.78 |
| Found % | 67.81 | 7.32 | 6.76 |

Synthesis of Exemplary Coupler Y-7

49.6 g (0.08 mol) of Intermediate D was dissolved in 300 ml of dichloromethane. 11.4 g (0.084 mol) of sulfuryl chloride was added dropwise to the solution while stirring at a temperature of 10° to 15° C.

The reaction system was allowed to undergo reaction at the same temperature for 30 minutes. 200 g of a 5% aqueous solution of sodium bicarbonate was added dropwise to the reaction mixture. The resulting organic phase was separated, washed with 200 ml of water, and then dried with anhydrous sodium sulfate. Dichloromethane was distilled off under reduced pressure to obtain 47 g of an oily matter.

47 g of the oily matter was dissolved in 200 ml of acetonitrile. 28.4 g (0.22 mol) of Compound D and 22.2 g (0.22 mol) of triethylamine were added to the solution while stirring. The reaction system was allowed to undergo reaction at a temperature of 40° to 50° C. for 4 hours, and then poured into 300 ml of water. The resulting oily matter was extracted with 300 ml of ethyl acetate. The resulting organic phase was washed with 200 g of a 5% aqueous solution of sodium hydroxide, and then twice washed with 300 ml of water. The organic phase was acidified by dilute hydrochloric acid, washed twice with water, and then concentrated under reduced pressure to obtain a residue. (Yield: 70 g)

The thus obtained oily matter was crystallized from a mixture of 50 ml of ethyl acetate and 100 ml of n-hexane to obtain 47.8 g (yield: 80%) of Exemplary Coupler Y-7. (Melting point: 145° to 147° C.)

TABLE 2

| Elemental analysis of Exemplary Coupler Y-7 | C | H | N |
|---|---|---|---|
| Calculated % | 64.32 | 6.75 | 7.50 |
| Found % | 64.31 | 6.73 | 7.50 |

SYNTHESIS EXAMPLE 2

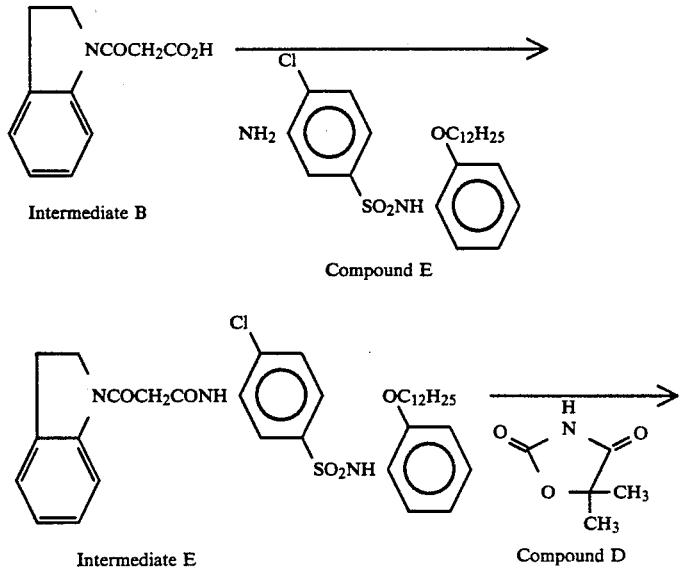

-continued

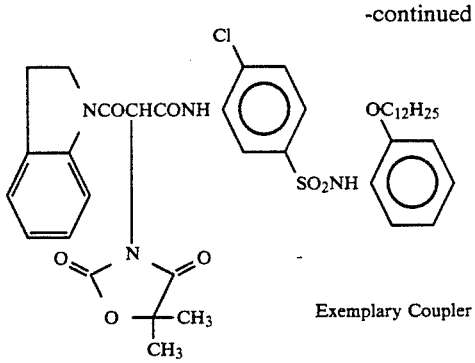

Exemplary Coupler Y-16

Synthesis of Intermediate E 90.3 g (0.44 mol) of Intermediate B and 187 g (0.4 mol) of Compound E were dissolved in 500 ml of ethyl acetate and 300 ml of dimethyl formamide. A solution of 131.9 g (0.64 mol) of dicyclohexyl carbodiimide in 200 ml of acetonitrile was added dropwise to the solution while stirring at a temperature of 15° to 30° C.

The reaction system was allowed to undergo reaction at a temperature of 20° to 30° C. for 2 hours. The resulting dicyclohexyl urea was filtered off. To the filtrate were added 500 ml of ethyl acetate and 600 ml of water. The resulting aqueous phase was removed. The organic phase was washed twice with water. The organic phase was dried with anhydrous sodium sulfate. Ethyl acetate was distilled off under reduced pressure to obtain 281 g of an oily matter.

The thus obtained oily matter was dissolved in 1.5 l of n-hexane at an elevated temperature. Insoluble matters were filtered off. The n-hexane solution was cooled with water. The resulting intermediate was filtered off to obtain Intermediate E. (Yield: 243.4 g (93%); m.p. 103°-105° C.).

TABLE 3

| Elemental analysis of Intermediate E | C | H | N |
|---|---|---|---|
| Calculated % | 64.25 | 6.78 | 6.42 |
| Found % | 64.24 | 6.76 | 6.43 |

Synthesis of Exemplary Coupler Y-16

39.3 g (0.06 mol) of Intermediate E was dissolved in 200 ml of dichloromethane. 8.7 g (0.064 mol) of sulfuryl chloride was added dropwise to the solution while stirring at a temperature of 10° to 15° C.

The reaction system was allowed to undergo reaction at the same temperature for 30 minutes. 200 g of a 4% aqueous solution of sodium bicarbonate was added dropwise to the reaction mixture. The resulting organic phase was separated, washed with 200 ml of water, and then dried with anhydrous sodium sulfate. Dichloromethane was distilled off under reduced pressure to obtain 41.3 g of an oily matter.

41.3 g of the oily matter was dissolved in 100 ml of acetonitrile and 200 ml of dimethyl acetamide. 20.8 g (0.16 mol) of Compound D and 16.2 g of triethylamine were added to the solution while stirring. The reaction system was allowed to undergo reaction at a temperature of 30° to 40° C. for 3 hours, and then poured into 400 ml of water. The resulting oily matter was extracted with 300 ml of ethyl acetate. The resulting organic phase was washed with 300 g of a 2% aqueous solution of sodium hydroxide, and then twice washed with water. The organic phase was acidified by dilute hydrochloric acid, washed twice with water, and then concentrated under reduced pressure to obtain 42 g of a residue.

The thus obtained residue was crystallized from 200 ml of methanol to obtain 39.8 g (yield: 85%) of Exemplary Coupler Y-16. (Melting point: 110° to 112° C.)

TABLE 4

| Elemental analysis of Exemplary Coupler Y-16 | C | H | N |
|---|---|---|---|
| Calculated % | 61.48 | 6.32 | 7.17 |
| Found % | 61.46 | 6.30 | 7.18 |

SYNTHESIS EXAMPLE 3

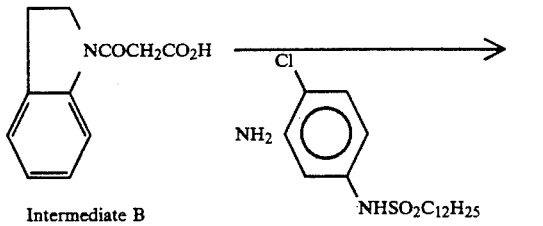

Intermediate B

Compound F

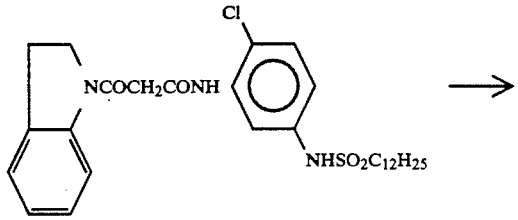

Intermediate F

-continued

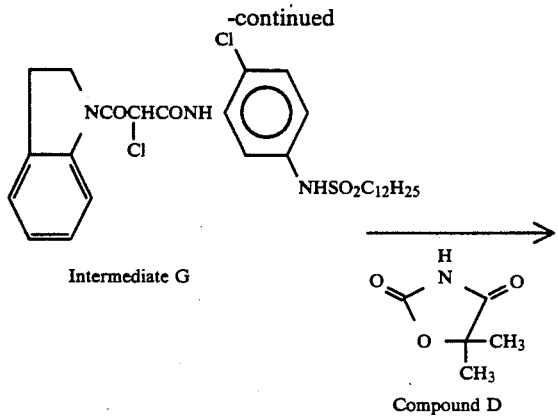

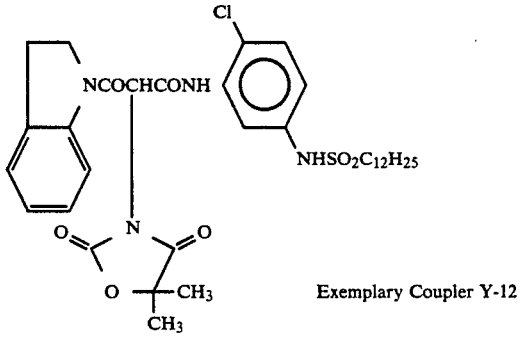

Synthesis of Intermediate F 104.7 g (0.51 mol) of Intermediate B and 187.5 g (0.5 mol) of Compound F were dissolved in 1 l of ethyl acetate and 400 ml of dimethyl formamide. A solution of 107.3 g (0.525 mol) of dicyclohexyl carbodiimide in 100 ml of dimethyl formamide was added dropwise to the solution while stirring at a temperature of 15° to 30° C. The reaction system was allowed to undergo reaction at a temperature of 20° to 30° C. for 1 hour. 500 ml of ethyl acetate was added to the reaction system. The reaction system was then heated to a temperature of 50° to 60° C. Dicyclohexyl urea was then filtered off.

To the filtrate was added 500 ml of water. The resulting aqueous phase was removed. The filtrate was washed twice with water. The resulting organic phase was dried with anhydrous sodium sulfate. Ethyl acetate was distilled off to obtain 290 g of an oily matter. The oily matter was heated in a mixture of 1 l of ethyl acetate and 2 of methanol. Insoluble matters were filtered off. The filtrate was cooled with water. The resulting crystal was recovered as Intermediate F by filtration. (Yield: 267 g (95%), m.p. 163°-164° C.)

TABLE 5

Elemental analysis of Intermediate F

| | C | H | N |
|---|---|---|---|
| Calculated % | 61.95 | 7.17 | 7.48 |
| Found % | 61.93 | 7.17 | 7.46 |

Synthesis of Intermediate G 114.0 g (0.2 mol) of Intermediate F was dissolved in 500 ml of dichloromethane. 28.4 g (0.21 mol) of sulfuryl chloride was added dropwise to the solution while stirring at a temperature of 10° to 15° C.

The reaction system was then allowed to undergo reaction at the same temperature for 30 minutes. 500 g of a 6% aqueous solution of sodium bicarbonate was added dropwise to the reaction mixture. The resulting organic phase was separated, washed with 500 ml of water, and then dried with anhydrous sodium sulfate. Dichloromethane was distilled off under reduced pressure. As a result, Intermediate G was crystallized. Intermediate G was then recovered by filtration. (Yield: 108.6 g (91%))

Synthesis of Exemplary Coupler Y-12

29.8 g (0.05 mol) of Intermediate G was dissolved in 80 ml of dimethylformamide. 12.9 g (0.1 mol) of Compound D was added to the solution. 10.1 g (0.10 mol) of triethylamine was added dropwise to the solution while stirring at a temperature of 20° to 30° C. The reaction system was allowed to undergo reaction at a temperature of 40° to 45° C. for 1 hour. To the reaction system were added 300 ml of ethyl acetate and 200 ml of water. The resulting organic phase was washed twice with 400 g of a 2% aqueous solution of sodium hydroxide, and then washed with water. The organic phase was acidified by dilute hydrochloric acid, washed twice with water, and then concentrated under reduced pressure to obtain 34 g of a residue. The residue was crystallized from a mixture of 50 ml of ethyl acetate and 150 ml of n-hexane to obtain 19 g of Exemplary Coupler Y-12.

The thus obtained crystal was recrystallized from 120 ml of a 1:3 (volumetric ratio) mixture of ethyl acetate and n-hexane to obtain 15 g (yield: 43.5%) of Exemplary Coupler Y-12. (Melting point: 135° to 136° C.)

TABLE 6

Elemental analysis of Exemplary Coupler Y-12

| | C | H | N |
|---|---|---|---|
| Calculated % | 59.24 | 6.58 | 8.13 |
| Found % | 59.27 | 6.56 | 8.12 |

SYNTHESIS EXAMPLE 4

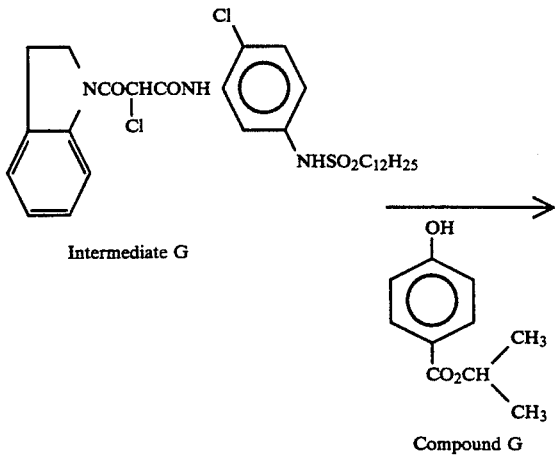

-continued

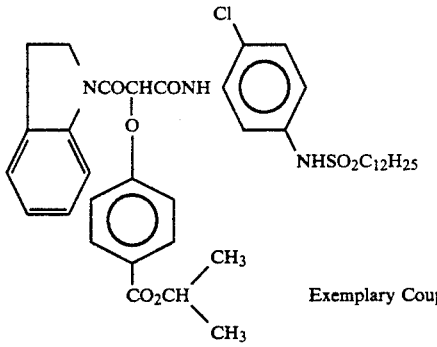

Exemplary Coupler Y-49

Synthesis of Exemplary Coupler Y-49

27.0 g (0.15 mol) of Compound G and 15.2 g (0.15 mol) of triethylamine were dissolved in 50 ml of dimethylformamide. A solution of 29.8 g (0.05 mol) of Intermediate G in 30 ml of dimethylformamide was added dropwise to the solution while stirring.

The reaction system was allowed to undergo reaction at a temperature of 30° to 40° C. for 4 hours. To the reaction system were added 400 ml of ethyl acetate and 300 ml of water. The resulting organic phase was washed with 400 g of a 2% aqueous solution of sodium hydroxide, and then washed twice with water. The organic phase was acidified by dilute hydrochloric acid, washed twice with water, and then dried with anhydrous sodium sulfate. Ethyl acetate was distilled off under reduced pressure to obtain 54 g of a residue.

The residue was then crystallized from 300 ml of a solvent mixture of 1:2 (volumetric ratio) of ethyl acetate and methanol. The resulting crystal was recovered as Exemplary Coupler Y-49 by filtration. The thus obtained crystal was recrystallized from 200 ml of a solvent mixture of 1:2 (volumetric ratio) of ethyl acetate and methanol. The crystal was recovered as Exemplary Coupler Y-49 in an amount of 28.8 g (yield: 77.8%). (Melting point: 190° to 191° C.)

TABLE 7

Elemental analysis of Exemplary Coupler Y-49

| | C | H | N |
|---|---|---|---|
| Calculated % | 63.26 | 6.81 | 5.68 |
| Found % | 63.24 | 6.79 | 5.67 |

The general formula [M] of the present invention will be further described hereinafter.

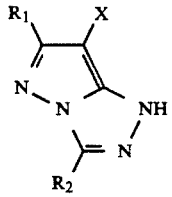

(M)

In the general formula (M), $R_1$ and $R_2$ each represents a hydrogen atom or a substituent, and X represents a hydrogen atom or a group which can be separated from the molecule upon a coupling reaction with an oxidation product of a developing agent.

$R_1$, $R_2$ and X in the general formula (M) will be further described hereinafter.

$R_1$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoyl amino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imide group, a heterocyclic thio group, a sulfinyl group, a phosphonyl group, an aryloxycarbonyl group, an acyl group, an azolyl group or a urethane group. $R_1$ may also be a divalent group which forms a bis-form unit.

More particularly, $R_1$ represents a hydrogen atom, a halogen atom (e.g., chlorine, bromine), an alkyl group (e.g., $C_{1-32}$ straight-chain or branched alkyl, aralkyl, alkenyl, alkynyl, cycloalkyl, cycloalkenyl, such as methyl, ethyl, propyl, isopropyl, t-butyl, tridecyl, 2-methanesulfonylethyl, 3-(3-pentadecylphenoxy)propyl, 3-(4-{2-[4-(4-hydroxyphenylsulfonyl)-phenoxy]-dodecanamide}phenyl}propyl, 2-ethoxytridecyl, trifluoromethyl, cyclopentyl, 3-(2,4-di-t-amylphenoxy)-propyl), an aryl group (e.g., phenyl, 4-t-butylphenyl, 2,4-di-t-amylphenyl, 4-tetradecanamidephenyl), a heterocyclic group (e.g., 2-furyl, 2-chenyl, 2-pyrimidinyl, 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-methylphenoxy, 4-t-butylphenoxy, 3-nitrophenoxy, 3-t-butyloxycarbamoylphenoxy, 3-methoxycarbamoyl), an acylamino group (e.g., acetamide, benzamide, tetradecanamide, 2-(2,4-di-t-amylphenoxy) butanamide, 4-(3-t-butyl-4-hydroxyphenoxy)butanamide, 2-{4-(4hydroxyphenylsulfonyl)-phenoxy}decanamide), an alkylamino group (e.g., methylamino, butylamino, dodecylamino, diethylamino, methylbutylamino), an anilino group (e.g., phenylamino, 2-chloroanilino, 2-chloro-5-tetradecanaminoanilino, 2-chloro-5-dodecyloxycarbonylanilino, N-acetylanilino, 2-chloro-5-{α-(3-t-butyl-4-hydroxyphenoxy)dodecanamide}-anilino), a ureido group (e.g., phenylureido, methyl-ureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy). propylthio), an arylthio group (e.g., phenylthio, 2-butoxy-5-t-octylphenylthio, 3-pentadecylphenylthio, 2-carboxyphenylthio, 4-tetradecanamidephenylthio), an alkoxycarbonylamino group (e.g., methoxycarbonylamino, tetradecyloxycarbonylamino), a sulfonamide group (e.g., methanesulfonamide, hexadecanesulfonamide, benzenesulfonamide, p-toluenesulfonamide, octadecanesulfonamide, 2-methoxy-5-t-butylbenzenesulfonamide), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)-propyl}-carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesuylfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imide group (e.g., N-succinimide, N-phthalimide, 3-octadecenylsuccinimide), a heterocyclic thio group (e.g., 2-benzothiazolylthio, 2,4-di-phenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl), or an azolyl group (e.g., imidazolyl, pyrazolyl, 3-chloropyrazole-1-il, triazolyl). Among these substituents, groups which may further contain substituents may be halogen atoms or organic substituents connected thereto via a carbon atom, an oxygen atom, a nitrogen atom or a sulfur atom.

Preferred among these substituents represented by $R_1$ are an alkyl group, an aryl group, an alkoxy group, an aryloxy group, an alkylthio group, a ureido group, a urethane group, and an acylamino group.

$R_2$ has the same meaning as the substituents represented by $R_1$ and is preferably a hydrogen atom, an alkyl group, an aryl group, a heterocyclic group, an alkoxy group, an aryloxy group, an alkylthio group, an arylthio group, an alkoxycarbonyl group, a carbamoyl group or an acyl group, more preferably an alkyl group, an aryl group, a heterocyclic group, an alkylthio group or an arylthio group.

X represents a hydrogen atom or a group which can be separated from the molecule upon reaction with an oxidation product of an aromatic primary amine color developing agent. Specific examples of such a separatable group include a halogen atom, an alkoxy group, an aryloxy group, an acyloxy group, an alkylsulfonyloxy group, an arylsulfonyloxy group, an acylamino group, an alkylsulfonamide group, an arylsulfonamide group, an alkoxycarbonyloxy group, an aryloxycarbonyloxy group, an alkylthio group, an arylthio group, a heterocyclic thio group, a carbamoylamino group, a 5- or 6-membered nitrogen-containing heterocyclic group, an imide group, and an arylazo group. These groups may be further substituted by groups which may be contained in $R_1$ as substituents.

Further specific examples of such a separatable group include a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkylsulfonyloxy group, an arylsulfonyloxy group (e.g., methanesulfonyloxy, toluenesulfonyloxy), an acylamino group (e.g., dichloroacetylamino, heptafluorobutyrylamino), an alkylsulfonamide group, an arylsulfonamide group (e.g., methanesulfonamino, trifluoromethanesulfonamino, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an alkylthio group, arylthio group, a heterocyclic thio group (e.g., dodecylthio, 1-carboxydodecylthio, phenylthio, 2-butoxy-5-t-octylphenylthio, tetrazolylthio), a carbamoylamino group (e.g., N-methylcarbamoylamino, N-phenylcarbamoylamino), a 5- or 6-membered nitrogen-containing heterocyclic group (e.g., imidazolyl, pyrazolyl, triazolyl, tetrazolyl, 1,2-dihydro-2-oxo-1-pyridyl), an imide group (e.g., succinimide, hydantoinyl), and an arylazo group (e.g., phenylazo, 4-methoxyphenylazo). X may also be a separatable group connected via a carbon atom to the molecule, e.g., in the form of a bis-form coupler obtained by the condensation of a four-equivalent coupler with aldehydes or ketones. Furthermore, X may contain a photographically useful group such as a development inhibitor and a development accelerator. Preferred examples of the group represented by X include a halogen atom, an alkoxy group, an aryloxy group, an alkylthio group, an arylthio group, and a 5- or 6-membered nitrogen-containing heterocyclic group connected to the coupling position of the molecule via a nitrogen atom.

The coupler of the present invention represented by the general formula (M) is preferably incorporated in a green-sensitive emulsion layer but may be incorporated in a light-insensitive interlayer. The amount of the coupler represented by the general formula (M) to be incorporated is normally in the range of 0.001 to 2 mol, preferably 0.01 to 0.5 mol per mol of silver in the emulsion layer. If the coupler represented by the general formula (M) is incorporated in the light-insensitive layer, its amount per unit area is similar to the case where it is incorporated in the emulsion layer.

General processes for the synthesis of the coupler of the present invention will be described hereinafter. The synthesis of a 1H-pyrazolo[5,1-c]-1,2,4-triazole skeleton can be accomplished by the methods as described in U.S. Pat. No. 3,725,067, JP-B-47-27411 and JP-B-48-30895 (the term "JP-B" as used herein means an "examined Japanese patent publication"), JP-A-54-145135, *Research Disclosure* No. 12443, and J. Chem. Soc. Perkin I. page 2047 (1977).

Furthermore, the methods as described in JP-A-2-134354 can be used.

General processes for the introduction of coupling-separatable groups will be described hereinafter.

(1) By introducing a halogen atom

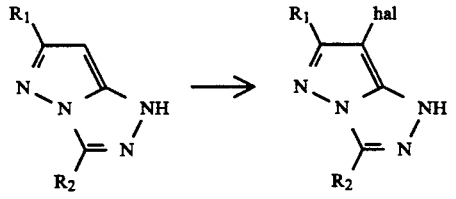

(A) (B)

wherein hal represents a halogen atom such as a chlorine atom and a bromine atom.

The halogenation at the coupling active position can be easily provided by allowing one equivalent of bromine or a halogenating agent such as imide N-bromosuccinate, sulfuryl chloride and imide N-chlorosuccinate to act on a four-equivalent coupler (A) in an inert solvent such as dichloromethane.

(2) By connecting an oxygen atom (a) Substitution of a halogen atom in a coupler containing the halogen atom in the coupling active position by a phenoxy group

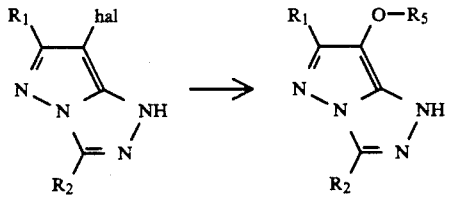

(B) (C)

A halogenated compound (B) is allowed to undergo reaction with a proper $R_5$-OM, $(R_5\text{-}O)_2M'$ or $(R_5\text{-}O)_3M''$ (in which $R_5$ represents an aryl group, and M, M' and M'' represent a monovalent, divalent and trivalent metallic ion, respectively) in a nonprotonic polar solvent such as dimethylformamide (DMF), dimethylsulfoxide (DMSO), hexamethylphosphoric triamide (HMPA) and N-methyl-2-pyrrolidone to obtain the desired compound (C) containing an aryloxy group in the coupling active position. Preferably, the halogenated compound (B) is reacted with one to twenty equivalents (molar ratio) of a sodium or potassium salt of a proper phenol in one to fifty equivalents (weight) of the solvent at a temperature of 50° to 150° C. This reaction may be accelerated by the addition of a quaternary ammonium salt such as tetrabutylammonium bromide or halogenated alkali metal such as cesium bromide.

(b) Formation of 1H-pyrazolo[5,1-c]-1,2,4-triazole skeleton after the introduction of an aryloxy group into active methylene in β-ketonitrile

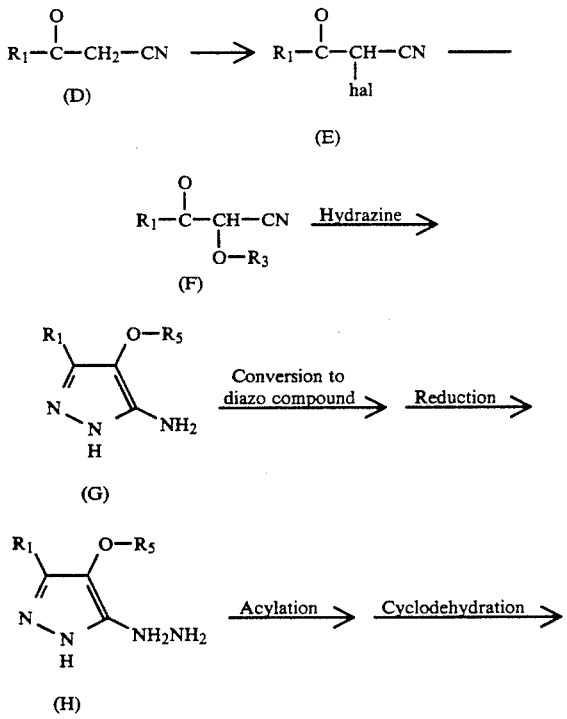

(D) (E) (F) (G) (H)

-continued

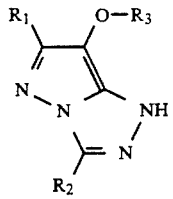

A halogenated compound (E) obtained by treating 3-oxonitrile (D) with a halogenating agent such as bromine and sulfuryl chloride in an inert solvent such as dichloromethane is treated with a proper $R_5$-OH or the above mentioned metallic salt such as $R_5$-OM in the presence of a tertiary amine to obtain an aryloxy compound (F). An aminopyrazole obtained by the reaction of the aryloxy compound (F) with hydrazine hydrate in a solvent such as ethanol is treated with sodium nitrite or isoamyl nitrite and an acid (e.g., hydrochloric acid or sulfuric acid) to produce a diazonium salt. The diazonium salt is then treated with a reducing agent such as stannous chloride, sodium sulfite and sodium hydrosulfite to obtain a hydrazinopyrazole compound (H). The hydrazinopyrazole compound (H) is subjected to the above mentioned skeleton synthesis to produce the desired coupler.

The synthesis of 3-oxonitrile (D) can be accomplished by any suitable method as described in U.S. Pat. No. 4,411,753, German Patent Application DE 3,209,472, and Synthesis, 472 (1977).

(3) By connecting sulfur atom

The synthesis of a coupler containing an aromatic mercapto or heterocyclic mercapto group in its 7-position can be accomplished by the method as described in U.S. Pat. No. 3,227,554, i.e., by dissolving an arylmercaptane, heterocyclic mercaptane and their corresponding disulfides in a halogenated hydrocarbon solvent, treating the material with chlorine or sulfuryl chloride to produce sulfenylchloride, and then adding the material to a four-equivalent coupler dissolved in a nonprotonic solvent. The introduction of an alkylmercapto group into the 7-position of the coupler can be accomplished by the method as described in U.S. Pat. No. 4,264,723, i.e., by introducing a mercapto group into the coupling active position of the coupler, and then allowing a halide to act on the mercapto group, or by using a single process with an S-(alkylthio)isothiourea and hydrochloride (or bromate).

(4) By connecting nitrogen atom (a) Introducing an amino group into the coupling active position and modifying the amino group The introduction of an amino group into the coupling active position can be easily provided by the method as described in U.S. Pat. No. 3,419,391, i.e., by converting the group at the coupling active position to a nitroso group, reducing it by a proper method, and then modifying the resulting amino compound or by coupling a diazonium salt derived from anilineanthranilic acid, sulfanilic acid, etc. to the coupling active position to obtain an azo dye, reducing it with a proper reducing agent such as sodium hydrosulfite to obtain an amino compound, and then modifying the amino compound.

(b) Introducing a halogen atom into the coupling active position, and substituting the halogen atom by $R_8(R_9)N$— group $R_8(R_9)N$— wherein $R_8$ and $R_9$ each represents an alkyl group, an aryl group or a heterocyclic group or may be nitrogen-containing heterocyclic groups which may be connected to each other to form a 5- or 6-membered ring together with a nitrogen atom and the above mentioned halogen-substituted compound (B) are allowed to undergo reaction at a temperature of 0° C. to 180° C. in an alcohol solvent, nonprotonic polar solvent or halogenated hydrocarbon solvent in the presence of a proper base to obtain the desired coupler.

Specific examples of the compound of the present invention represented by the general formula (M) will be set forth below, but the present invention should not be construed as being limited thereto.

M-1

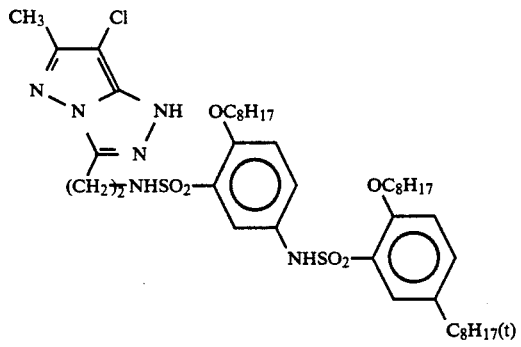

M-2

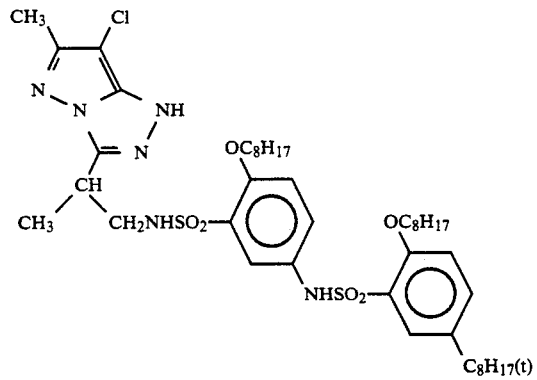

M-3

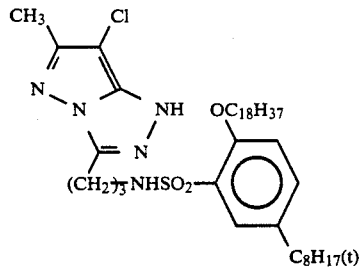

M-4

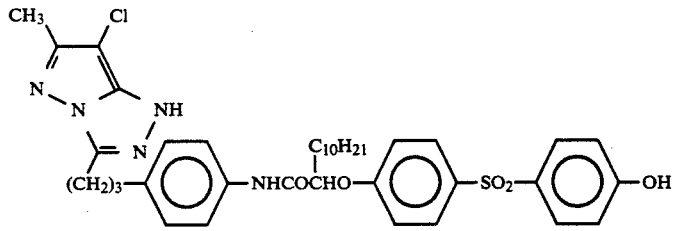

M-5

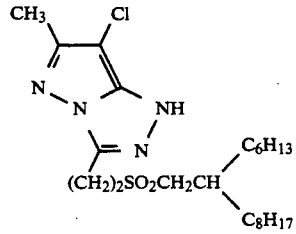

-continued
M-6
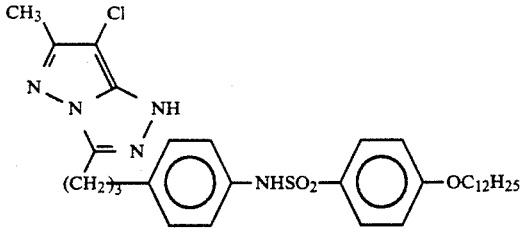
M-7
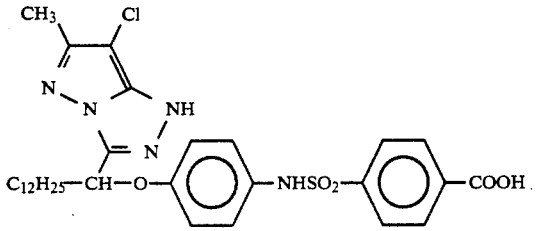
M-8
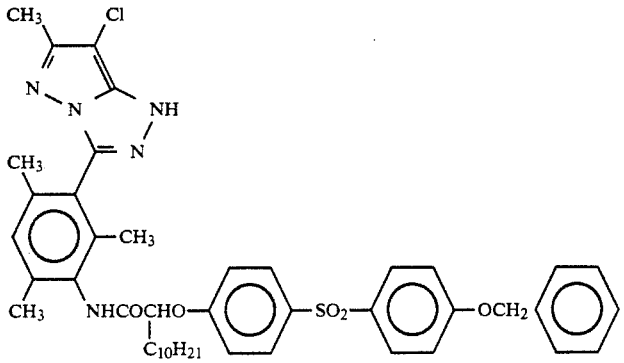
M-9
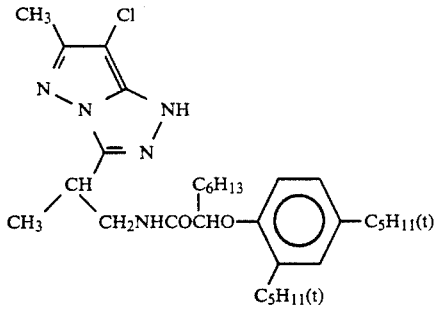
M-10
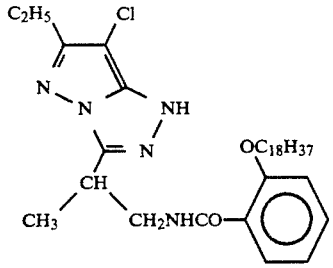
M-11
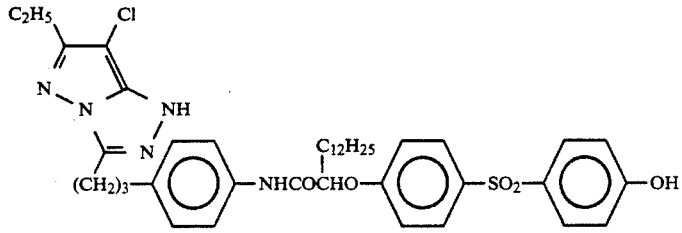

-continued
M-12
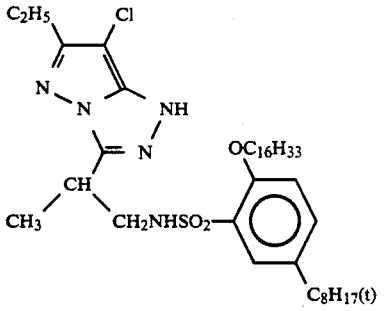
M-13
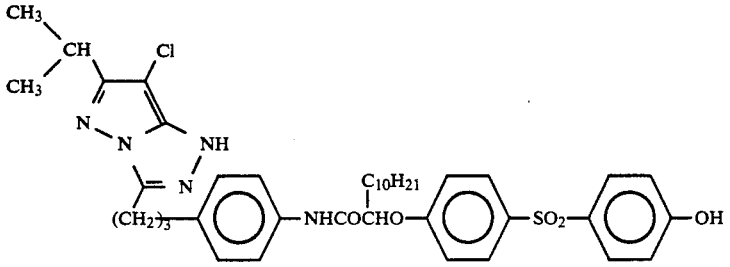
M-14
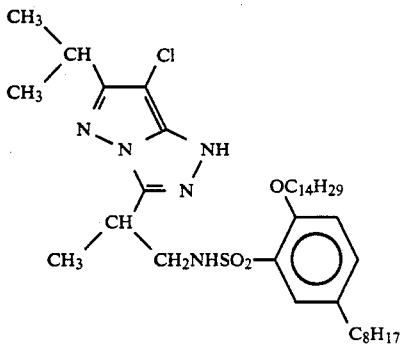
M-15
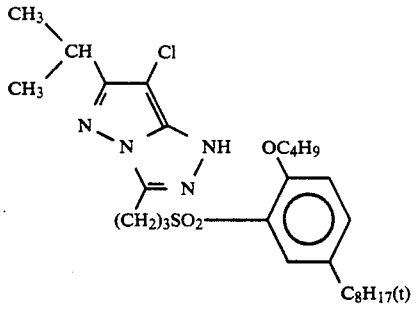
M-16
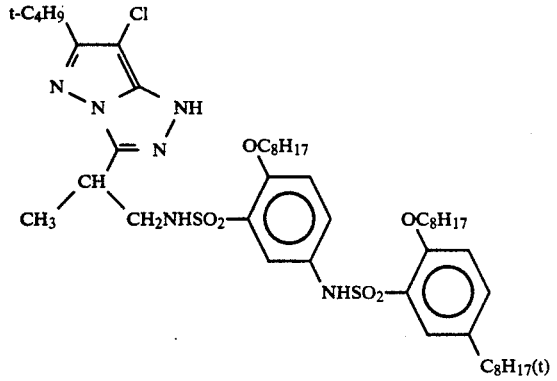

-continued
M-17
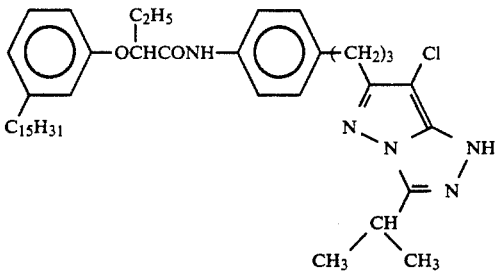
M-18
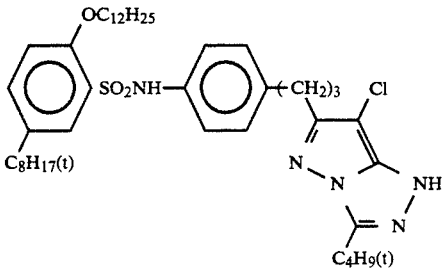
M-19
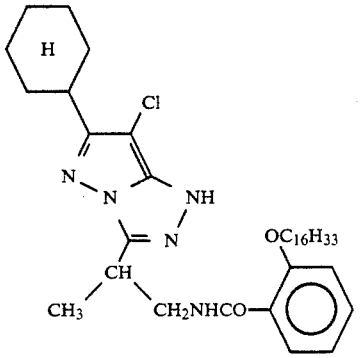
M-20
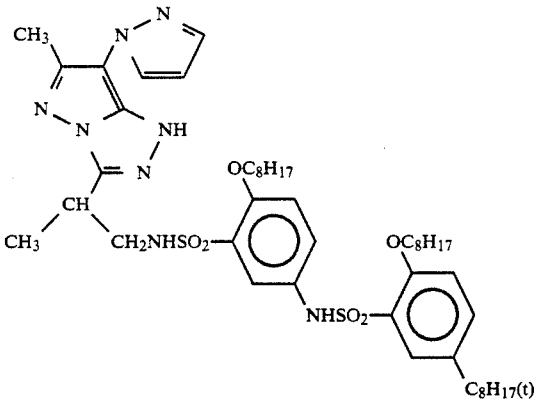
M-21
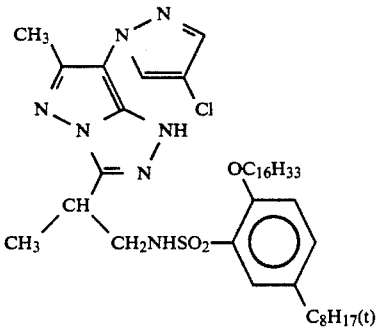

-continued
M-22
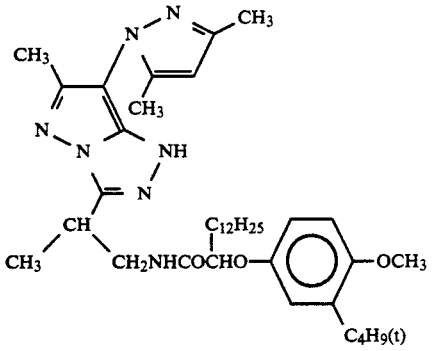
M-23
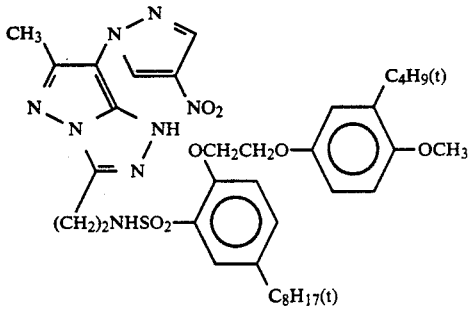
M-24
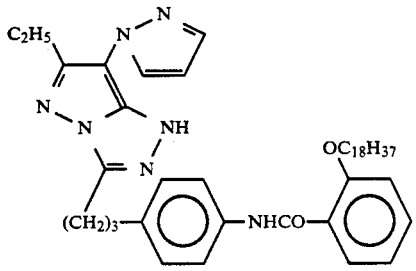
M-25
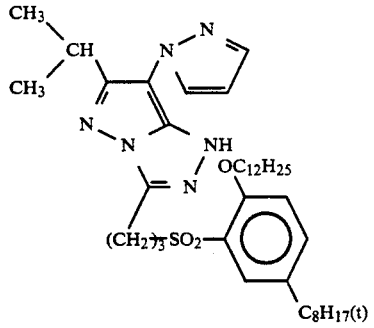
M-26
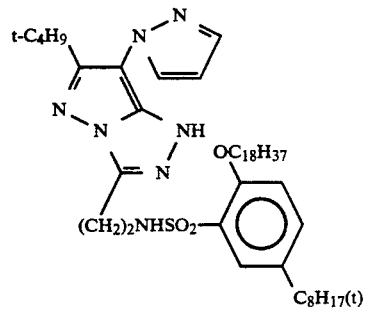

-continued
M-27
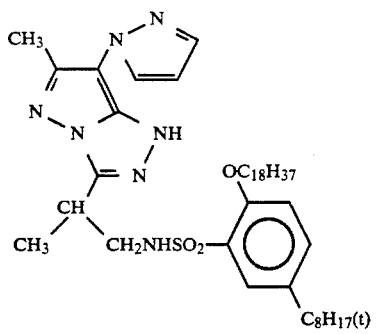
M-28
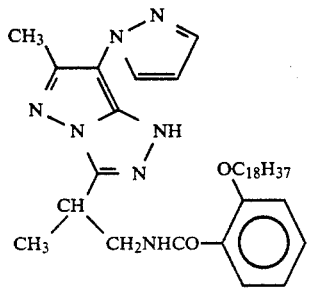
M-29
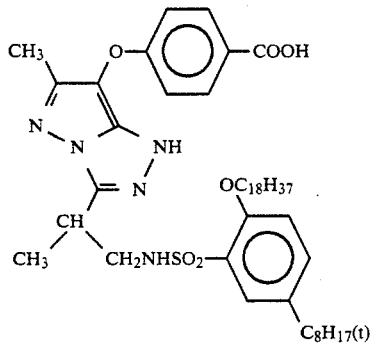
M-30
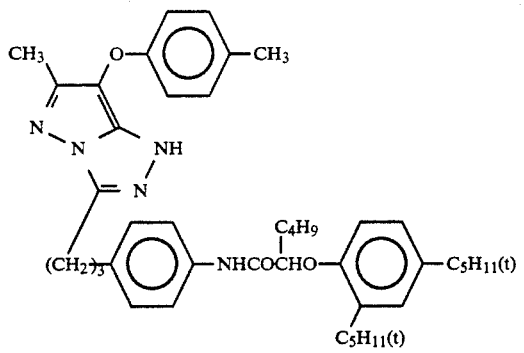
M-31
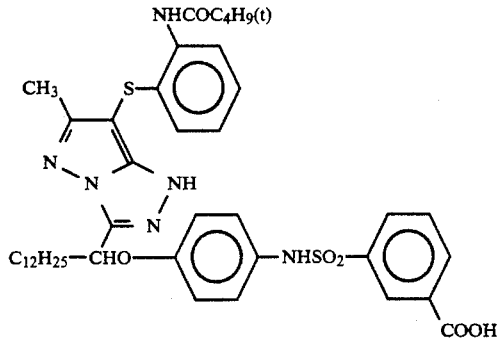

-continued
M-32
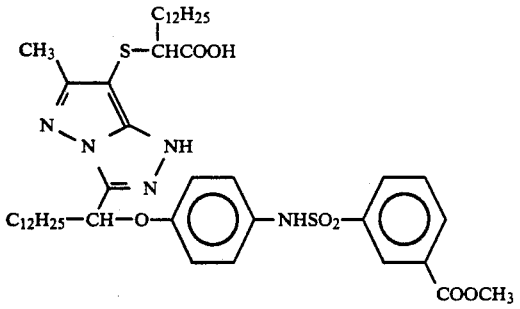
M-33
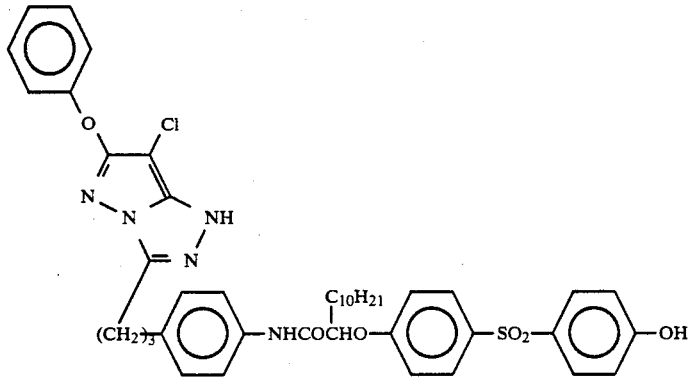
M-34
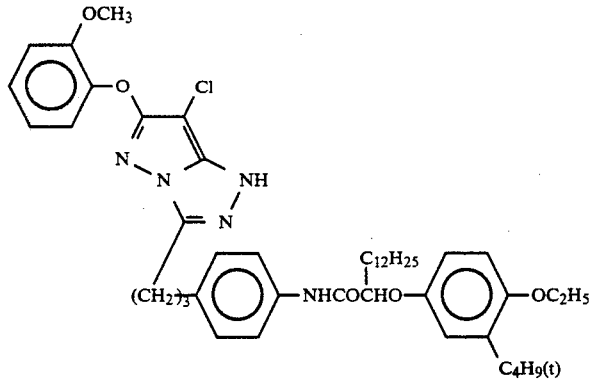
M-35
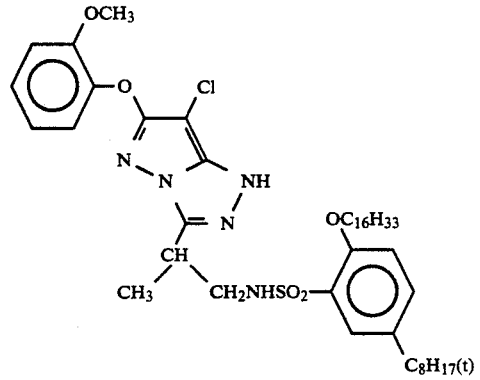

-continued
M-36
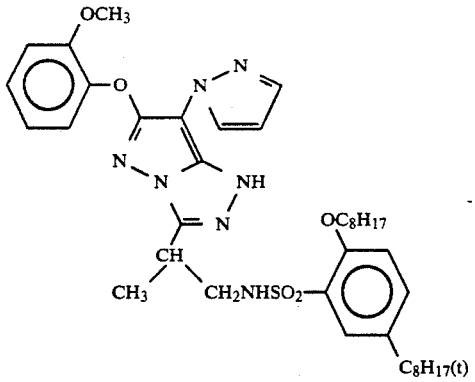
M-37
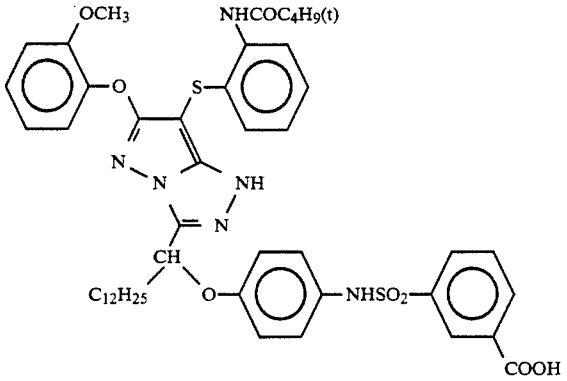
M-38
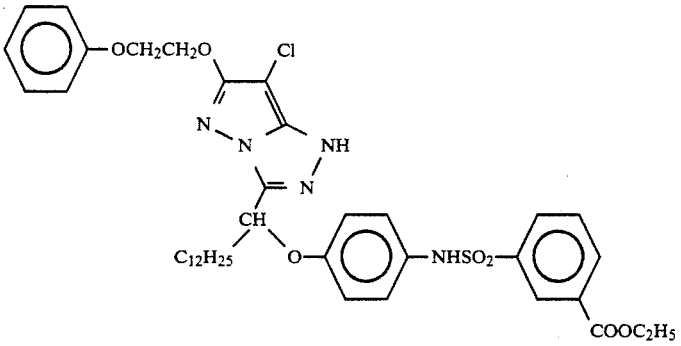
M-39
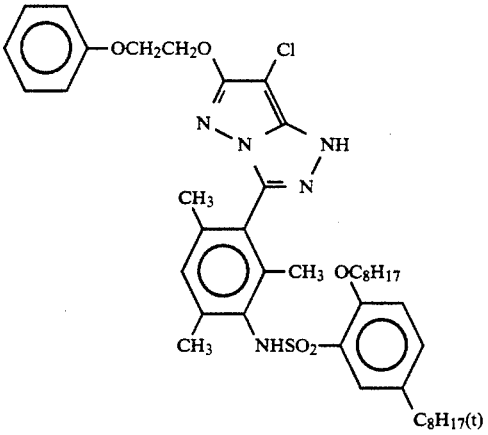

-continued
M-40
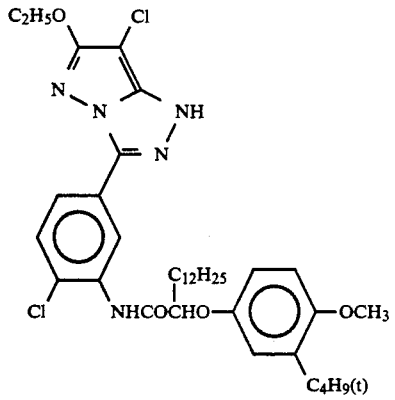
M-41
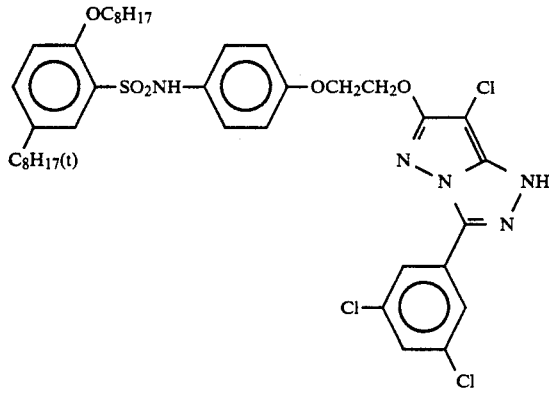
M-42
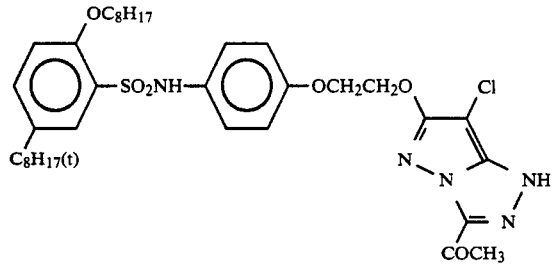
M-43
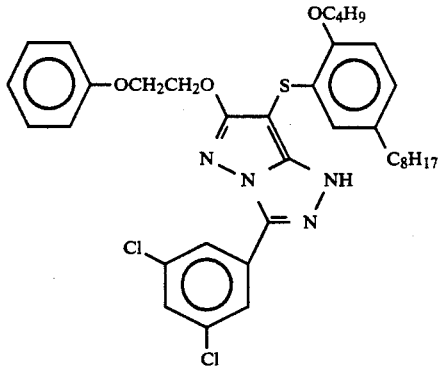

-continued
M-44
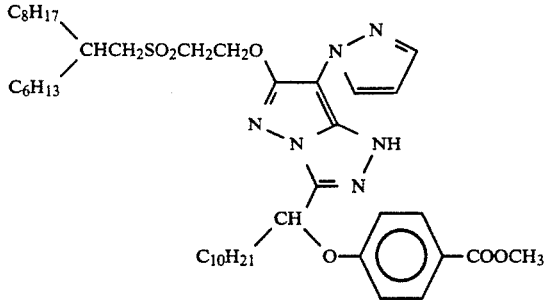
M-45
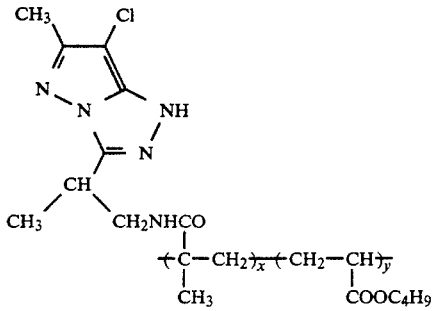
x:y = 1:1 (by weight)
M-46
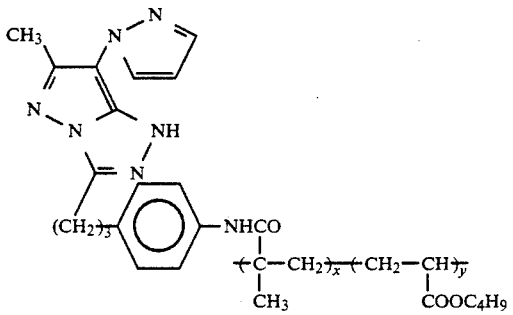
x:y = 1:1 (by weight)
M-47
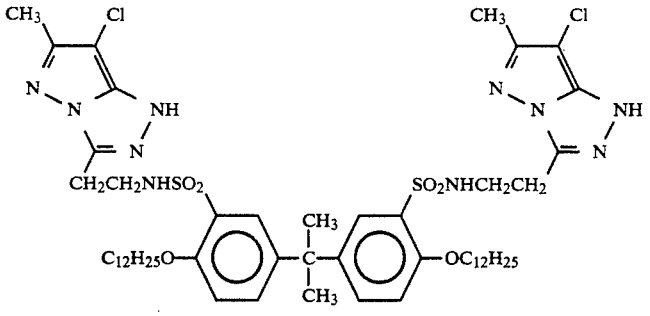
M-48
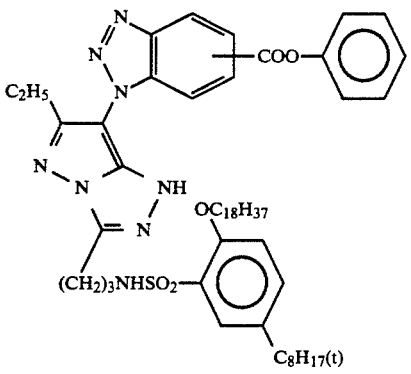

-continued
M-49
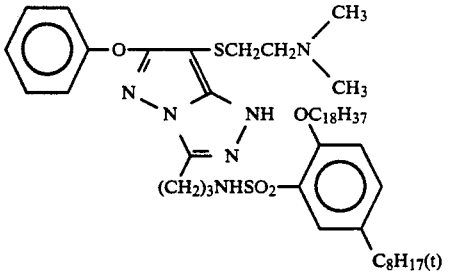
M-50
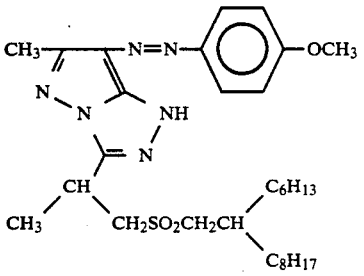
M-51
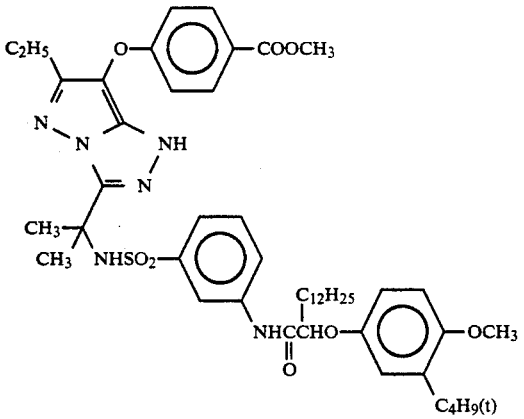
M-52
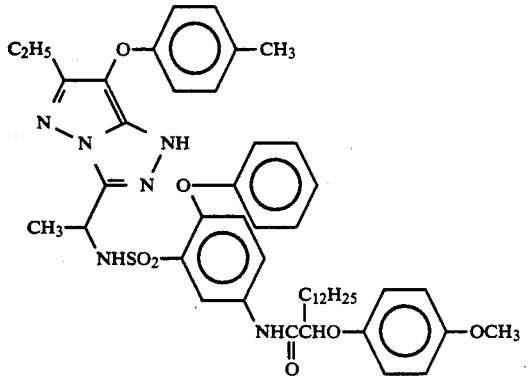

-continued
M-53
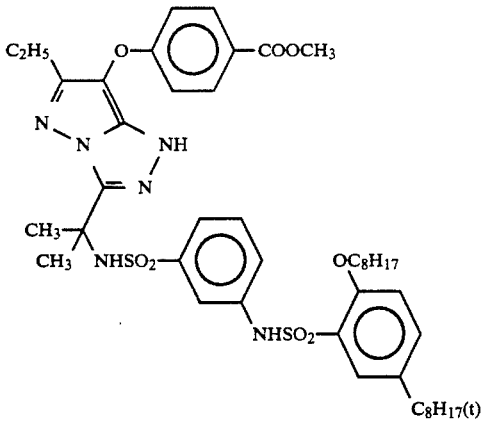
M-54
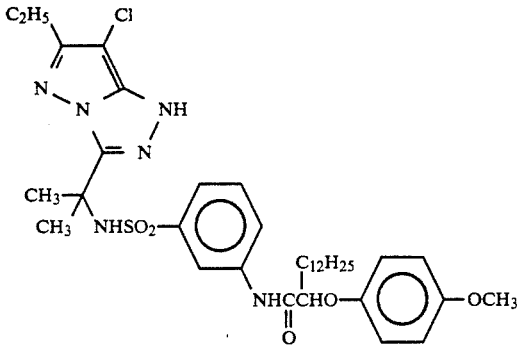
M-55
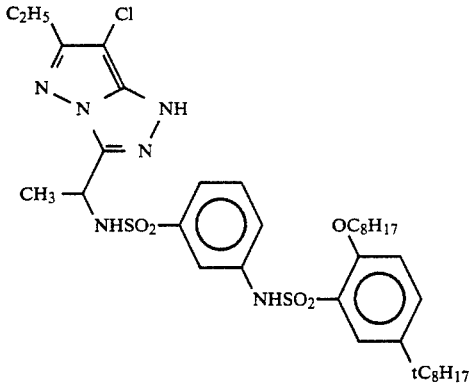
M-56
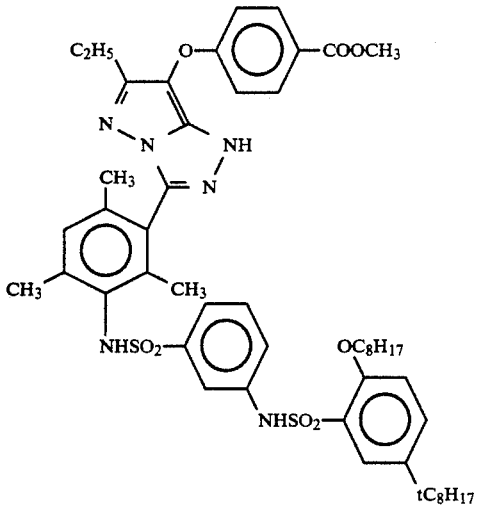

-continued
M-57
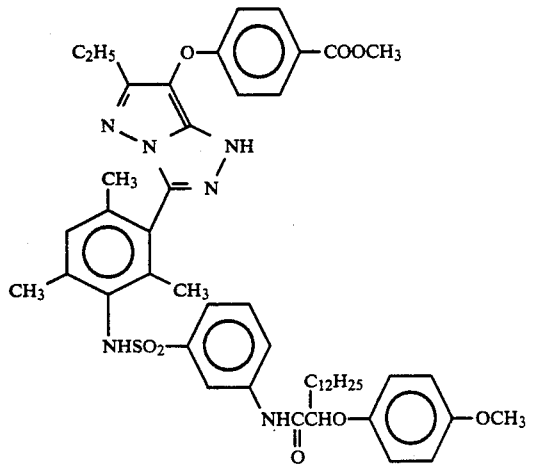
M-58
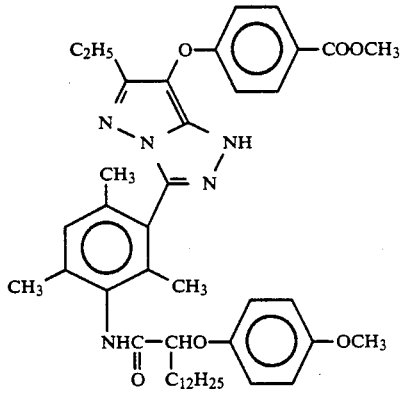
M-59
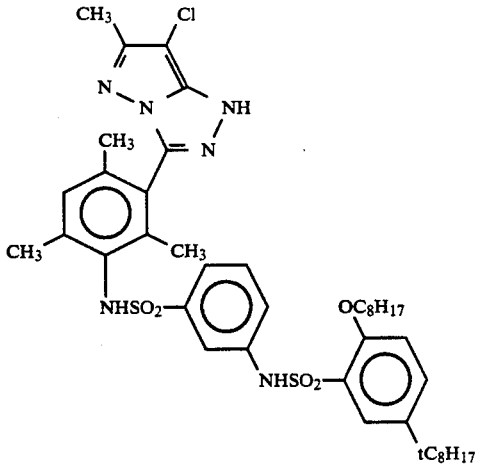

-continued

M-60

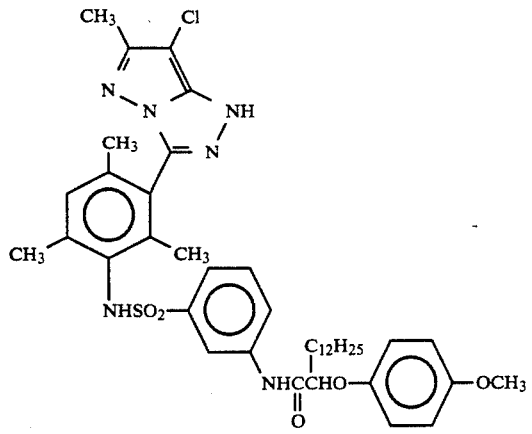

M-61

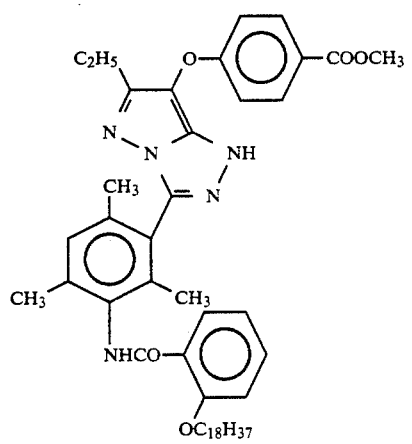

M-62

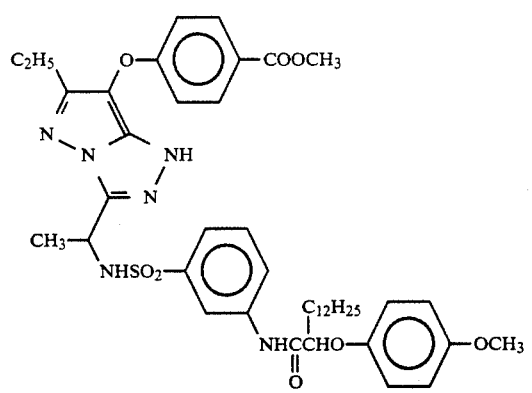

The yellow couplers of the present invention represented by the general formulae (1) to (5) can be each used in an amount of 1.0 to $1.0\times10^{-3}$ mol, preferably $5.0\times10^{-1}$ to $2.0\times10^{-2}$ mol, more preferably $4.0\times10^{-1}$ to $5.0\times10^{-2}$ mol per mol of silver halide.

Two or more of the yellow couplers of the present invention represented by the general formulae (1) to (5) can be used in combination. These couplers can be used in combination with other known couplers. However, the added amount of the other known couplers should be within such a range that the effects of the present invention are not badly influenced by the addition of the other known couplers. This applies to the coupler represented by the general formula (M).

The incorporation of the couplers (1) to (5) of the present invention in the light-sensitive material can be accomplished by any suitable known dispersion method.

In an oil-in-water dispersion process, a low boiling organic solvent (e.g., ethyl acetate, butyl acetate, methyl ethyl ketone, isopropanol) may be used to coat a fine dispersion so that the low boiling organic solvent does not substantially remain in the dried film. If a high boiling organic solvent is used, any organic solvent having a boiling point of 175° C. or higher under normal pressure may be used. One or more of such high boiling organic solvents may be used in admixture. The ratio of these high boiling organic solvents to the coupler of the present invention can be widely selected. In general, the weight ratio of the high boiling organic solvent per g of the coupler is in the range of 5.0 or less, preferably 0 to 2.0, more preferably 0.01 to 1.0.

Further, the latex dispersion process as mentioned below can be used.

Moreover, the present couplers can be used in admixture with or in the presence of various couplers or compounds as mentioned herein-below.

The silver halide color photographic light-sensitive material of the present invention can comprise at least one blue- sensitive layer, at least one green-sensitive layer and at least one red-sensitive layer on a support. The number of silver halide emulsion layers and light-insensitive layers and the order of arrangement of these layers are not specifically limited. In a typical embodiment, the silver halide photographic material of the present invention comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red sensitive layer, green-sensitive layer and blue-sensitive layer as viewed from the support. However, the order of arrangement can be optionally reversed depending on the purpose or desired application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color stain inhibitor as commonly used.

The plurality of silver halide emulsion layers constituting each unit light-sensitive layer can preferably be in a two-layer structure, i.e., high sensitivity emulsion layer and low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided remote from the support while a high sensitivity emulsion layer can be provided nearer to the support.

In an embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B-55-34932, a blue-sensitive layer, GH, RH, GL, and RL can be arranged in this order remote from the support. Alternatively, as described in JP-A-56-25738 and JP-A-62-63936, a blue-sensitive layer, GL, RL, GH, and RH can be arranged in this order remote from the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangement, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order remote from the support in the same color-sensitive layer as described in JP-A-59-202464.

Further, a high sensitivity emulsion layer, a low sensitivity emulsion layer, and a middle sensitivity emulsion layer, or a low sensitivity emulsion layer, a middle sensitivity emulsion layer, and a high sensitivity emulsion layer can be arranged in this order remote from the support. In the case of a four- or more than four-layer structure, too, the arrangement of the emulsion layers can be altered.

In order to improve color reproducibility, a donor layer (CL) having an interimage effect and a spectral sensitivity distribution different from the main light-sensitive layer such as BL, GL and RL is preferably provided adjacent to or in close proximity to the main light-sensitive layer as described in U.S. Pat. Nos. 4,663,271, 4,705,744, and 4,707,436, and JP-A-62-160448 and JP-A-63-89850.

As described above, various layer structures and arrangements can be selected depending on the purpose of the light-sensitive material.

A suitable silver halide to be incorporated into the photographic emulsion layer in the photographic light-sensitive material to be used in the present invention is silver bromoiodide, silver chloroiodide or silver bromochloroiodide containing silver iodide in an amount of about 30 mol % or less. Particularly suitable is silver bromoiodide containing silver iodide in an amount of about 2 mol % to about 10 mol %.

Silver halide grains in the photographic emulsions may be so-called regular grains having a regular crystal form, such as cube, octahedron and tetradecahedron, or those having an irregular crystal form such as sphere and tablet, those having a crystal defect such as twinning plane, or those having a combination of these crystal forms.

The silver halide grains may be either fine grains of about 0.2 μm or smaller in diameter or giant grains having a projected area diameter of up to about 10 μm, preferably fine grains having a diameter of 0.1 to 0.2 μm. The emulsion may be either a monodisperse emulsion or a polydisperse emulsion.

The preparation of the silver halide photographic emulsion which can be used in the present invention can be accomplished by any suitable method as described in *Research Disclosure* No. 17643 (December 1978), pp. 22–23, "I. Emulsion Preparation and Types", and No. 18716 (November 1979), page 648, Glafkides, "Chimie et Physique Photographique", Paul Montel (1967), G. F. Duffin, "Photographic Emulsion Chemistry", Focal Press, 1966, and V. L. Zelikman et al., "Making and Coating Photographic Emulsion Focal Press", 1964.

Furthermore, monodisperse emulsions as described in U.S. Pat. Nos. 3,574,628 and 3,655,394, and British Patent 1,413,748 can be preferably used in the present invention.

Tabular grains having an aspect ratio of about 5 or more can be used in the present invention. The preparation of such tabular grains can be easily accomplished by any suitable method as described in Gutoff, "Photographic Science and Engineering", vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition by an epitaxial junction, or the grains may be joined with a compound other than silver halide, e.g., silver thiocyanate, lead oxide, etc. Mixtures of grains having various crystal forms may also be used.

The above-mentioned emulsion may be of the surface latent image type in which latent images are mainly formed on the surface of grains or the internal latent image type in which latent images are mainly formed inside grains or the type in which latent images are formed both on the surface and inside grains. The emulsion needs to be a negative type emulsion. If the emulsion is of the internal latent image type, it may be a core/shell type internal latent image emulsion as disclosed in JP-A-63-264740. A process for the preparation of such a core/shell type internal latent image emulsion is described in JP-A-59-133542. In this emulsion, the thickness of the shell depends on the development process, etc. and is preferably in the range of 3 to 40 nm, particularly 5 to 20 nm.

The silver halide emulsion to be used in the present invention is normally subjected to physical ripening, chemical ripening and spectral sensitization. Additives to be used in these steps are described in *Research Disclosure* Nos. 17643, 18716 and 307105 as tabulated below.

In the light-sensitive material of the present invention, two or more kinds of light-sensitive silver halide emulsions which are different in at least one of grain size, grain size distribution, halogen composition, grain shape and sensitivity may be incorporated in the same layer in admixture.

Surface-fogged silver halide grains as disclosed in U.S. Pat. No. 4,082,553, internally-fogged silver halide grains as described in U.S. Pat. No. 4,626,498 and JP-A-59-214852, or colloidal silver may preferably be incorporated in a light-sensitive silver halide emulsion layer and/or substantially light-insensitive hydrophilic colloidal layer. The term "internally- or surface-fogged silver halide grains" as used herein means "silver halide grains which can be uniformly (nonimagewise) developed regardless of whether they are present in the exposed portion or unexposed portion on the light-sensitive material". Processes for the preparation of internally- or surface-fogged silver halide grains are described in U.S. Pat. No. 4,626,498, and JP-A-59-214852.

Silver halides forming the core of internally-fogged core/shell type silver halide grains may have the same or different halogen compositions. Internally or surface-fogged silver halide grains may comprise any of silver chloride, silver bromochloride, silver bromoiodide and silver bromochloroiodide. The size of these fogged silver halide grains is not specifically limited, and its average grain size is preferably in the range of 0.01 to 0.75 μm, particularly 0.05 to 0.6 μm. The crystal form of these grains is not specifically limited and may be regular. These emulsions may be polydisperse but are preferably monodisperse (silver halide grains at least 95% by weight or number of which are those having grain diameters falling within ±40% from the average grain size).

In the present invention, light-insensitive finely divided silver halide grains are preferably used. Light-insensitive finely divided silver halide grains are silver halide grains which are not light-sensitive at the time of the imagewise exposure for taking of dye images so that they are not substantially developed during the development process. Preferably, these silver halide grains are not previously fogged.

These finely divided silver halide grains have a silver bromide content of 0 to 100 mol % and may optionally contain silver chloride and/or silver iodide, preferably 0.5 to 10 mol % of silver iodide.

These finely divided silver halide grains preferably have an average diameter of 0.01 to 0.5 μm, more preferably 0.02 to 0.2 μm as calculated in terms of the diameter of a circle having the same area as the projected area of the grain.

These finely divided silver halide grains can be prepared in the same manner as ordinary light-sensitive silver halide. In this case, the surface of the silver halide grains does not need to be optically or spectrally sensitized. However, prior to the addition of the emulsion to a coating solution, a known additive such as a triazole, azaindene, benzothiazolium or mercapto compound and a zinc compound is preferably added to the emulsion. Colloidal silver is preferably incorporated in the layer containing these finely divided silver halide grains.

The coated amount of silver in the light-sensitive material of the present invention is preferably in the range of 6.0 g/m$^2$ or less, most preferably 4.5 g/m$^2$ or less.

Known photographic additives which can be used in the present invention are also described in the above cited three *Research Disclosures* as tabulated below.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | do. | |
| 3. Spectral Sensitizer, Supersensitizer | pp. 23–24 | p. 648, RC to p. 649, RC | pp. 866–868 |
| 4. Brightening Agent | p. 24 | p. 647, RC | p. 868 |
| 5. Antifoggant, Stabilizer | pp. 24–25 | p. 649, RC | pp. 868–870 |
| 6. Light Absorber, Filter Dye, Ultrasonic Absorber | pp. 25–26 | p. 649, RC to p. 650, left column (LC) | p. 873 |
| 7. Stain Inhibitor | p. 25, RC | p. 650, LC to RC | p. 872 |
| 8. Dye Image Stabilizer | p. 25 | p. 650, LC | do. |
| 9. Hardening Agent | p. 26 | p. 651, LC | pp. 874–875 |
| 10. Binder | p. 26 | do. | pp. 873–874 |
| 11. Plasticizer, Lubricant | p. 27 | p. 650, RC | p. 876 |
| 12. Coating Aid, Surface Active Agent | pp. 26–27 | p. 650, RC | pp. 875–876 |
| 13. Antistatic Agent | p. 27 | do. | pp. 876–877 |
| 14. Matting Agent | | | pp. 878–879 |

In order to inhibit the deterioration of photographic properties due to formaldehyde gas, a compound capable of reacting with and fixing formaldehyde as disclosed in U.S. Pat. Nos. 4,411,987 and 4,435,503 can be incorporated into the light-sensitive material.

The light-sensitive material of the present invention preferably contains a mercapto compound as disclosed in U.S. Pat. Nos. 4,740,454, and 4,788,132, and JP-A-62-18539, and JP-A-1-283551.

The light-sensitive material of the present invention preferably contains a fogging agent, a development accelerator, a silver halide solvent or a compound for releasing precursors thereof as disclosed in JP-A-1-106052 regardless of the amount of developed silver produced by development.

The light-sensitive material of the present invention preferably contains a dye which has been dispersed by a method as disclosed in International Patent Disclosure W088/04794 and JP-A-1-502912 or a dye as disclosed in EP317,308A, U.S. Pat. No. 4,420,555, and JP-A-1-259358.

Various color couplers can be used in the present invention. Specific examples of the color couplers are described in the patents described in the above cited *Research Disclosure* No. 17643, VII-C to G, and No. 307105, VII-C to G.

Preferred yellow couplers include those represented by the general formulae (1) to (5), and those described in U.S. Pat. Nos. 3,933,501, 4,022,620, 4,326,024, 4,401,752, 4,248,961, 3,973,968, 4,314,023, and 4,511,649, JP-B-58-10739 (the term "JP-B" as used herein means an "examined Japanese patent publication"), British Patents 1,425,020 and 1,476,760, and European Patent 249,473A.

Preferred magenta couplers include those represented by the general formula (M), and 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, JP-A-60-43659, JP-A-61-72238, JP-A-60-35730, JP-A-55-118034, and JP-A-60-185951, RD Nos. 24220 (June 1984) and 24230 (June 1984), and W088/04795. Further, the following couplers 1) to 5) are preferred among pyrazolo[1,5-a]benzimidazole couplers described in W091/01984.

1)

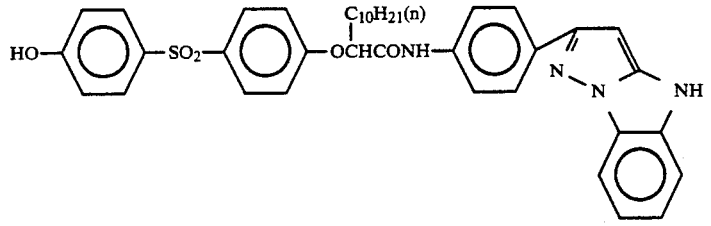

2)

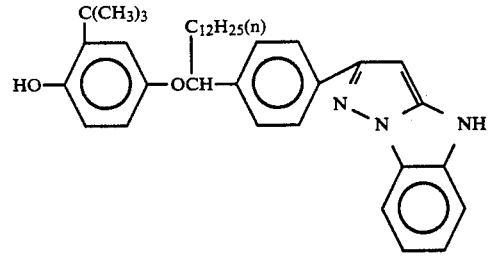

3)

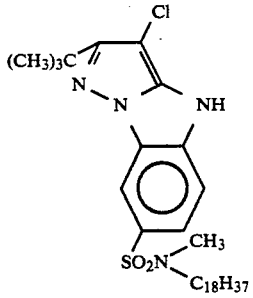

4)

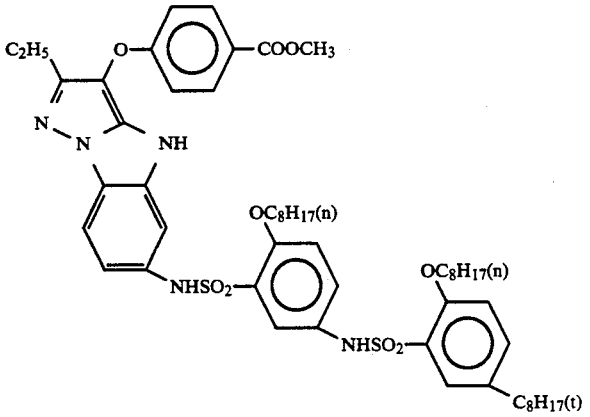

-continued

5) 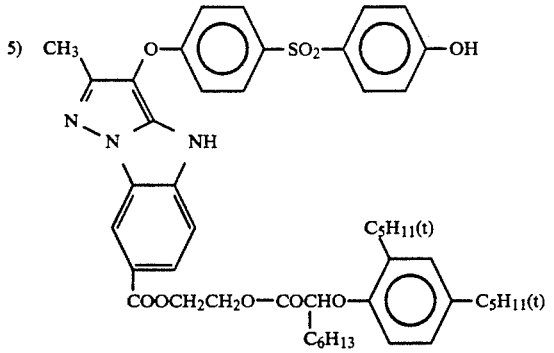

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Disclosure No. 3,329,729, European Patents 121,365A and 249,453A, and JP-A-61-42658. Further, pyrazoloazole couplers as disclosed in JP-A-64-553, JP-A-64-554, JP-A-64-555, and JP-A-64-556 and imidazole couplers as disclosed in U.S. Pat. No. 4,818,672 can be used.

Typical examples of polymerized dye-forming couplers are described in U.S. Pat. Nos. 3,451,820, 4,080,211, 4,367,282, 4,409,320, and 4,576,910, British Patent 2,102,173, and European Patent 341,188A.

Couplers which form a dye having moderate diffusibility preferably include those described in U.S. Pat. No. 4,366,237, British Patent 2,125,570, European Patent 96,570, and West German Patent Publication No. 3,234,533.

Colored couplers for correction of unnecessary absorptions of the developed dye preferably include those described in Research Disclosure No. 17643, VII-G, Research Disclosure No. 307105, VII-G, U.S. Pat. Nos. 4,163,670, 4,004,929, and 4,138,258, JP-B-57-39413, and British Patent 1,146,368. Furthermore, couplers for correction of unnecessary absorption of the developed dye by a fluorescent dye released upon coupling as described in U.S. Pat. No. 4,774,181 and couplers containing as a separatable group a dye precursor group capable of reacting with a developing agent to form a dye as described in U.S. Pat. No. 4,777,120 can preferably be used.

Compounds capable of releasing a photographically useful residual upon coupling can also be used in the present invention. Preferred examples of DIR couplers which release a developing inhibitor are described in the patents cited in RD 17643, VII-F, JP-A-57-151944, JP-A-57-154234, JP-A-60-184248, JP-A-63-37346,and JP-A-63-37350, and U.S. Pat. Nos. 4,248,962, and 4,782,012.

Bleach accelerator-releasing couplers as disclosed in RD Nos. 11449, and 24241, and JP-A-61-201247 are effective for the reduction of time required for a processing step having bleaching capability. In particular, when incorporated in a light-sensitive material comprising the above-mentioned tabular silver halide grains, these couplers exhibit its effect at a maximum. Couplers capable of imagewise releasing a nucleating agent or a developing accelerator at the time of development preferably include those described in British Patents 2,097,140 and 2,131,188, and JP-A-59-157638 and JP-A-59-170840. Further, compounds which undergo a redox reaction with the oxidation product of a developing agent to release a fogging agent, a development accelerator, a silver halide solvent or the like as disclosed in JP-A-60-107029, JP-A-60-252340, JP-A-1-44940, and JP-A-1-45687 are preferred.

In addition to the foregoing couplers, the photographic material according to the present invention can further contain competing couplers as described in U.S. Pat. No. 4,130,427, polyequivalent couplers as described in U.S. Pat. Nos. 4,283,472, 4,338,393, and 4,310,618, DIR redox compounds or DIR couplers or DIR coupler-releasing couplers as described in JP-A-60-185950 and JP-A-62-24252, couplers capable of releasing a dye which returns to its original color after release as described in European Patents 173,302A and 313,308A, couplers capable of releasing a ligand as described in U.S. Pat. No. 4,553,477, couplers capable of releasing a leuco dye as described in JP-A-63-75747, and couplers capable of releasing a fluorescent dye as described in U.S. Pat. No. 4,774,181.

The incorporation of the couplers of the present invention in the light-sensitive material can be accomplished by any suitable known dispersion method.

Examples of high boiling solvents to be used in the oil-in-water dispersion process are described in U.S. Pat. No. 2,322,027. Specific examples of high boiling organic solvents having a boiling point of 175° C. or higher at normal pressure which can be used in the oil-in-water dispersion process include phthalic esters (e.g., dibutyl phthalate, dicylohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of a latex dispersion method and specific examples of latexes to be used in dipping are described in U.S. Pat. No. 4,199,363, West German Patent Application (OLS) 2,541,274, and 2,541,230.

The color light-sensitive material of the present invention preferably contains various antiseptics or antifungal agents such as phenetyl alcohol and 1,2-benzisothiazoline-3-one, n-butyl, p-hydroxybenzoate, phenol, 4-chloro-3,5-dimethylphenol, 2-phenoxyethanol and 2-(4-thiazolyl)benzimidazole as described in JP-A-63-257747, JP-A-62-272248 and JP-A-1-80941.

The present invention is applicable to various types of color light-sensitive materials, particularly preferably to color negative films for common use or motion picture, color reversal films for slide or television, color papers, color positive films and color reversal papers.

Suitable supports which can be used in the present invention are described in the above cited RD 17643 (page 28), No. 18716 (right column on page 647 to left column on page 648), and No. 307105 (page 897).

In the light-sensitive material of the present invention, the total thickness of all hydrophilic colloidal layers on the emulsion side is preferably in the range of 28 μm or less, more preferably 23 μm or less, further preferably 18 μm or less, particularly 16 μm or less. The film swelling rate $T_{\frac{1}{2}}$ is preferably in the range of 30 seconds or less, more preferably 20 seconds or less. In the present invention, the film thickness is determined after being stored at a temperature of 25° C. and a relative humidity of 55% for 2 days. The film swelling rate $T_{\frac{1}{2}}$ can be determined by a method known in the art, e.g., by means of a swellometer of the type as described in A. Green et al, "Photographic Science and Engineering", vol. 19, No. 2, pp. 124–129. $T_{\frac{1}{2}}$ is defined as the time taken until half the saturated film thickness is reached wherein the saturated film thickness is 90% of the maximum swollen film thickness reached when the light-sensitive material is processed with a color developer at a temperature of 30° C. over 195 seconds.

The film swelling rate $T_{\frac{1}{2}}$ can be adjusted by adding a film hardener to gelatin as a binder or altering the aging condition after coating. The percentage of swelling of the light-sensitive material is preferably in the range of 150 to 400%. The percentage of swelling can be calculated from the maximum swollen film thickness determined as described above in accordance with the equation: (maximum swollen film thickness-film thickness)-/film thickness.

The light-sensitive material of the present invention preferably comprises a hydrophilic colloidal layer (hereinafter referred to as "back layer") having a total dried thickness of 2 μm to 20 μm on the side other than the emulsion layer side. The back layer preferably contains the above-mentioned light absorbent, filter dye, ultraviolet absorbent, antistatic agent, film hardener, binder, plasticizer, lubricant, coating aid, surface active agent, etc. The back layer preferably exhibits a percentage of swelling of 150 to 500%.

The color photographic light-sensitive material according to the present invention can be developed in accordance with an ordinary method as described in RD Nos. 17643 (pp. 28–29), 18716 (left column-right column on page 651) and 30710 (pp. 880–881).

The color developer to be used in the development of the light-sensitive material of the present invention is preferably an alkaline aqueous solution containing as a main component an aromatic primary amine color developing agent. As such a color developing agent there can effectively be used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-methoxyethylaniline, and sulfates, hydrochlorides and p-toluenesulfonates thereof. Particularly preferred among these compounds is 3-methyl-4-amino-N-ethyl-N-β-hydroxyethylaniline sulfate. These compounds can be used in combination of two or more thereof depending on the purpose or intended application.

The color developer normally contains a pH buffer such as a carbonate and a phosphate of an alkaline metal or a development inhibitor or a fog inhibitor such as bromides, iodides, benzimidazoles, benzothiazoles and mercapto compounds. If desired, the color developer may further contain various preservatives such as hydroxylamine, diethylhydroxylamine, sulfites, hydrazines (e.g., N,N-biscarboxymethylhydrazine), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphoric acids, alkylphosphonic acids, and phosphonocarboxylic acids, (e.g., ethylenediaminetetraacetic acid, nitrilotriacetic acid, diethylenetriaminepentaacetic acid, cyclohexanediaminetetraacetic acid, hydroxyethyliminoacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof).

Reversal processing is usually carried out by black-and-white development followed by color development. Black-and-white developers to be used can contain one or more of the known black-and-white developing agents, such as dihydroxybenzenes, e.g., hydroquinone, 3-pyrazolidones, e.g., 1-phenyl-3pyrazolidone, and aminophenols, e.g., N-methyl-p-aminophenol. The color developer or black-and-white developer usually has a pH from 9 to 12. The replenishment rate of the developer is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. If the replenishment rate is reduced, the area of the processing tank in contact with the air is preferably reduced to inhibit the evaporation and air oxidation of the processing solution.

The area of the photographic processing solution in contact with the air in the processing tank can be represented by an opening value as defined by the following equation:

$$\text{Opening value} = \frac{\text{Contact area of processing solution and air (cm}^2\text{)}}{\text{Volume of processing solution (cm}^3\text{)}}$$

The opening value as defined above is preferably in the range of 0.1 or less, more preferably 0.001 to 0.05. Examples of methods for reducing the opening value include a method which comprises putting a cover such as floating lid on the surface of the processing solution in the processing tank, a method as disclosed in JP-A-1-82033 utilizing a removable lid, and a slit development method as disclosed in JP-A-63-216050. The reduction of the opening value is preferably effected in both color development and black-and-white development steps as well as all the subsequent steps such as bleach, blix, fixing, rinse and stabilization. The replenishment rate can also be reduced by a means for suppressing the accumulation of the bromide ion in the developing solution.

The color processing time is normally in the range of 2 to 5 minutes. The processing time can be further reduced by carrying out color development at an elevated temperature and a high pH value with a color developing solution containing a color developing agent in a high concentration.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of polyvalent metals, e.g., iron (III), peroxides, quinones, and nitro compounds. Typical examples of these bleaching agents are organic complex salts of iron (III), e.g., with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc. Of these, aminopolycarboxylic acid-iron (III) complex salts such as (ethylenediaminetetraacetato)iron (III) complex salts and (1,3-diaminopropanetetraacetate)iron (III) complex salts are preferred in view of speeding up of processing and conservation of the environment. In particular, aminopolycarboxylic acid-iron (III) complex salts are useful in both of a bleaching solution and a blix solution. The pH value of a bleaching solution or a blix solution comprising such an aminopolycarboxylic acid-iron complex salt is normally in the range of 4.0 to 8. For speeding up of processing, the processing can be effected at an even lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patent 1,290,812, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and *Research Disclosure* No. 17129 (July 1978), thiazolidine derivatives as described in JP-A-50-140129, thiourea derivatives as described in U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A-49-40943, JP-A-49-59644, JP-A-53-94927, JP-A-54-35727, JP-A-55-26506, and JP-A-58-163940, and bromide ions. Preferred among these compounds are compounds containing a mercapto group or disulfide group because of their great acceleratory effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for picture taking.

The bleaching solution or blix solution preferably contains an organic acid besides the above-mentioned compounds for the purpose of inhibiting bleach stain. A particularly preferred organic acid is a compound with an acid dissociation constant (pKa) of 2 to 5. In particular, acetic acid, propionic acid, hydroxyacetic acid, etc. are preferred.

Examples of fixing agents to be contained in the fixing solution or blix solution include thiosulfates, thiocyanates, thioethers, thioureas, and a large amount of iodides. The thiosulfates are normally used. In particular, ammonium thiosulfate can be most widely used. Further, thiosulfates are preferably used in combination with thiocyanates, thioether compounds, thioureas, etc. As preservatives for the fixing or blix bath there can preferably be used sulfites, bisulfites, carbonyl bisulfite adducts or sulfinic acid compounds as described in European Patent 294769A. The fixing solution or blix solution preferably contains aminopolycarboxylic acids or organic phosphonic acids for the purpose of stabilizing the solution.

In the present invention, the fixing solution or blix solution preferably contains a compound with a pKa of 6.0 to 9.0, more preferably imidazoles such as imidazole, 1-methylimidazole, 1-ethylimidazole and 2-methylimidazole in an amount of 0.1 to 10 mol/l for the purpose of adjusting the pH.

The total time required for the desilvering step is preferably as short as possible so long as no desilvering failure coccurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can effectively be inhibited.

In the desilvering step, the agitation is preferably intensified as much as possible. Specific examples of such an agitation intensifying method include a method as described in JP-A-183460 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into the emulsion film, resulting in an improvement in the desilvering rate. The above-mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A-60-191257, JP-A-60-191258, and JP-A-60-191259. Such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photographic materials of the invention are subjected to washing and/or stabilization. The quantity of water to be used in the washing can be selected from a broad range depending on the characteristics of the light-sensitive material (for example, the kind of couplers, etc.}, the end use of the light-sensitive material, the temperature of washing water, the number of washing tanks (number of stages), the replenishment system (e.g., counter-flow system or direct-flow system), and other various factors. Of these factors, the relationship between the number of washing tanks and the quantity of water in a multistage counter-flow system can be obtained according to the method described in "Journal of the Society of Motion Picture and Television Engineers", vol. 64, pp. 248–253 (May 1955). According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine typoe bactericides, e.g., chlorinated sodium isocyanurate, benzotriazole, and bactericides described in Hiroshi Horiguchi, "Bokinbobaizai no kagaku (Chemistry of Bactericidal and Fungicidal Agents)" (1986), Eisei Gijutsu Gakkai (ed.), "Biseibutsu no mekkin, sakkin, bobaigijutsu (Bactericidal and Fungicidal Techniques to Microorganisms)" (1982), and Nippon Bokin Bobi Gakkai (ed.), "Bokin bobizai jiten (Encyclopedia of Bactericidal and Fungicidal Agents)" (1986).

The washing water has a pH value from 4 to 9, preferably from 5 to 8. The temperature of the water and the washing time can be selected from broad ranges depending on the characteristics and end use of the light-sensitive material, but usually ranges from 15 to 45° C. in temperature and from 20 seconds to 10 minutes in time, preferably from 25 to 40° C. in temperature and from 30 seconds to 5 minutes in time. The light-sensitive material of the invention may be directly processed with a stabilizer in place of the washing step. For the stabilization, any of the known techniques as described in JP-A-57-8543, JP-A-58-14834, and JP-A-60-220345 can be used.

The aforesaid washing step may be followed by stabilization in some cases. For example, a stabilizing bath containing a dye stabilizer and a surface active agent is used as a final bath for color light-sensitive materials for picture taking. Examples of such a dye stabilizer include aldehydes such as formalin and glutaraldehyde, N-methylol compounds, hexamethylenetetramine, and aldehyde suffurous acid adducts. This stabilizing bath may also contain various chelating agents.

The overflow accompanying replenishment of the washing bath and/or stabilizing bath can be reused in other steps such as desilvering.

In the processing using an automatic developing machine, if the various processing solutions are concentrated by evaporation, water is preferably added to the system to correct for concentration.

The silver halide color light-sensitive material of the present invention may contain a color developing agent for the purpose of simplifying and expediting processing Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and *Research Disclosure* Nos. 14,850 and 15,159, and aldol compounds as described in *Research Disclosure* No. 13,924, metal complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such compounds are described in JP-A-56-64339, JP-A-57-144547, and JP-A-58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

Further, the silver halide light-sensitive material of the present invention can also be applied to a heat-developable light-sensitive material as disclosed in U.S. Pat. No. 4,500,626, JP-A 60-133449, JP-A-59-218443, and JP-A-61-238056, and European Patent 210,660A2.

The present invention will be further described in the following examples, but the present invention should not be construed as being limited thereto.

EXAMPLE 1

Preparation of Sample 101

A multilayer color light-sensitive material was prepared as Sample 101 by coating on a 127-μm thick undercoated cellulose triacetate film support various layers having the following compositions. The figures indicate the amount of compositions added per $m^2$.The effects of the compounds added are not limited to those specified.

1st Layer: anti-halation layer

-continued

| | |
|---|---|
| Black colloidal silver | 0.20 g |
| Gelatin | 1.9 g |
| Ultraviolet absorbent U-1 | 0.04 g |
| Ultraviolet absorbent U-2 | 0.1 g |
| Ultraviolet absorbent U-3 | 0.1 g |
| Ultraviolet absorbent U-4 | 0.1 g |
| Ultraviolet absorbent U-6 | 0.1 g |
| High boiling organic solvent Oil-1 | 0.1 g |
| Solid dispersion of microcrystal of Dye E-1 | 0.1 g |
| 2nd Layer: interlayer | |
| Gelatin | 0.40 g |
| Compound Cpd-D | 5 mg |
| Compound Cpd-L | 5 mg |
| Compound Cpd-M | 3 mg |
| High boiling organic solvent Oil-3 | 0.1 g |
| Dye D-4 | 0.4 mg |
| 3rd layer: interlayer | |
| Emulsion of surface- and internally-fogged finely divided silver bromoiodide grains (average grain diameter: 0.06 μm; fluctuation coefficient: 18%; AgI content: 1 mol%) | 0.05 g (in terms of silver) |
| Gelatin | 0.4 g |
| 4th Layer: low sensitivity red-sensitive emulsion layer | |
| Emulsion A | 0.1 g (in terms of silver) |
| Emuslion B | 0.4 g (in terms of silver) |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-D | 10 mg |
| High boiling organic solvent Oil-2 | 0.1 g |
| 5th Layer: middle sensitivity red-sensitive emulsion layer | |
| Emulsion B | 0.2 g (in terms of silver) |
| Emulsion C | 0.3 g (in terms of silver) |
| Gelatin | 0.8 g |
| Coupler C-1 | 0.2 g |
| Coupler C-2 | 0.05 g |
| Coupler C-3 | 0.2 g |
| Coupler C-9 | 0.05 g |
| High boiling organic solvent Oil-2 | 0.1 g |
| 6th Layer: high sensitivity red-sensitive emulsion layer | |
| Emulsion D | 0.4 g (in terms of silver) |
| Gelatin | 1.1 g |
| Coupler C-1 | 0.3 g |
| Coupler C-2 | 0.1 g |
| Coupler C-3 | 0.7 g |
| Coupler C-9 | 0.1 g |
| Additive P-1 | 0.1 g |
| 7th Layer: interlayer | |
| Gelatin | 0.6 g |
| Additive M-1 | 0.3 g |
| Color stain inhibitor Cpd-K | 2.6 mg |
| Ultraviolet absorbent U-1 | 0.1 g |
| Ultraviolet absorbent U-6 | 0.1 g |
| Dye D-1 | 0.02 g |
| Compound Cpd-D | 5 mg |
| Compound Cpd-L | 5 mg |
| Compound Cpd-M | 5 mg |
| 8th Layer: interlayer | |
| Emulsion of surface- and internally-fogged silver bromoiodide grains (average grain diameter: 0.06 μm; fluctuation coefficient: 16%; AgI content: 0.3 mol %) | 0.02 g (in terms of silver) |
| Gelatin | 1.0 g |
| Additive P-1 | 0.2 g |
| Color stain inhibitor Cpd-N | 0.1 g |
| Color stain inhibitor Cpd-A | 0.1 g |
| 9th Layer: low sensitivity green-sensitive emulsion layer | |

-continued

| | |
|---|---|
| Emulsion E | 0.1 g (in terms of silver) |
| Emulsion F | 0.2 g (in terms of silver) |
| Emulsion G | 0.2 g (in terms of silver) |
| Gelatin | 0.5 g |
| Coupler C-4 | 0.05 g |
| Coupler C-7 | 0.25 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-1 | 0.1 g |
| High boiling organic solvent Oil-2 | 0.1 g |
| 10th Layer: middle sensitivity green-sensitive emulsion layer | |
| Emulsion G | 0.3 g (in terms of silver) |
| Emulsion H | 0.1 g (in terms of silver) |
| Gelatin | 0.6 g |
| Coupler C-4 | 0.1 g |
| Coupler C-7 | 0.3 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High boiling organic solvent Oil-2 | 0.01 g |
| 11th Layer: high sensitivity green-sensitive emulsion layer | |
| Emulsion I | 0.5 g (in terms of silver) |
| Gelatin | 1.0 g |
| Coupler C-4 | 0.4 g |
| Coupler C-7 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-1 | 0.02 g |
| High boiling organic solvent Oil-2 | 0.02 g |
| 12th Layer: interlayer | |
| Gelatin | 0.6 g |
| Dye D-1 | 0.1 g |
| Dye D-2 | 0.05 g |
| Dye D-3 | 0.07 g |
| 13th Layer: yellow filter layer | |
| Yellow colloidal silver | 0.07 g (in terms of silver) |
| Gelatin | 1.1 g |
| Color stain inhibitor Cpd-A | 0.01 g |
| High boiling organic solvent Oil-1 | 0.01 g |
| Solid dispersion of microcrystal of Dye E-2 | 0.05 g |
| 14th Layer: interlayer | |
| Gelatin | 0.6 g |
| 15th Layer: low sensitivity blue-sensitive emulsion layer | |
| Emulsion J | 0.2 g (in terms of silver) |
| Emulsion K | 0.3 g (in terms of silver) |
| Emulsion L | 0.1 g (in terms of silver) |
| Gelatin | 0.8 g |
| Coupler C-5 | 0.3 g |
| Coupler C-6 | 0.3 g |
| 16th Layer: middle sensitivity blue-sensitive emulsion layer | |
| Emulsion L | 0.1 g (in terms of silver) |
| Emulsion M | 0.4 g (in terms of silver) |
| Gelatin | 0.9 g |
| Coupler C-5 | 0.3 g |
| Coupler C-6 | 0.3 g |
| 17th Layer: high sensitivity blue-sensitive emulsion layer | |
| Emulsion N | 0.4 g (in terms of silver) |

-continued

| | |
|---|---|
| Gelatin | 1.2 g |
| Coupler C-5 | 0.1 g |
| Coupler C-6 | 0.6 g |
| 18th Layer: 1st protective layer | |
| Gelatin | 0.7 g |
| Ultraviolet absorbent U-1 | 0.04 g |
| Ultraviolet absorbent U-2 | 0.01 g |
| Ultraviolet absorbent U-3 | 0.03 g |
| Ultraviolet absorbent U-4 | 0.03 g |
| Ultraviolet absorbent U-5 | 0.05 g |
| Ultraviolet absorbent U-6 | 0.05- g |
| High boiling organic solvent Oil-1 | 0.02 g |
| Formalin scavenger | |
| Cpd-C | 0.2 g |
| Cpd-I | 0.4 g |
| Dye D-3 | 0.05 g |
| Compound Cpd-N | 0.02 g |
| 19th Layer: 2nd protective layer | |
| Colloidal silver | 0.1 mg (in terms of silver) |
| Emulsion of finely divided silver bromoiodide grains (average grain diameter: 0.06 μm; AgI content: 1 mol %) | 0.1 g (in terms of silver) |
| Gelatin | 0.4 g |

-continued

| | |
|---|---|
| 20th Layer: 3rd protective layer | |
| Gelatin | 0.4 g |
| Polymethyl methacrylate (average grain diameter: 1.5 μm) | 0.1 g |
| 4:6 (by weight) Copolymer of methyl methacrylate and acrylic acid (average grain diameter: 1.5 μm) | 0.1 g |
| Silicone oil | 0.03 g |
| Surface active agent W-1 | 3.0 mg |
| Surface active agent W-2 | 0.03 g |

To all the emulsion layers were further added Additives F-1 to F-8. To each of these layer were added a gelatin hardener H-1, and coating and emulsifying surface active agents W-3, W-4, W-5, W-6 and W-7 in addition to the above-mentioned compositions.

Moreover, phenol, 1,2-benzisothiazoline-3-one, 2-phenoxyethanol and phenethyl alcohol were added to each of these layers as antiseptic agents and anti-fungal agents.

Silver bromoiodide emulsions incorporated in Sample 101 were as follows:

TABLE 8

| Emulsion | | Average grain diameter in terms of sphere (μm) | Fluctuation coefficient (%) | AgI content (%) |
|---|---|---|---|---|
| A | Monodisperse tetradecahedral grain | 0.28 | 16 | 3.7 |
| B | Monodisperse cubic internal latent image type grain | 0.30 | 10 | 3.3 |
| C | Monodisperse tabular grain with average aspect ratio of 4.0 | 0.38 | 18 | 5.0 |
| D | Monodisperse tabular grain with average aspect ratio of 7.0 | 0.68 | 25 | 2.0 |
| E | Monodisperse cubic grain | 0.20 | 17 | 4.0 |
| F | Monodisperse cubic grain | 0.23 | 16 | 4.0 |
| G | Monodisperse cubic internal latent image type grain | 0.28 | 11 | 3.5 |
| H | Monodisperse cubic internal latent image type grain | 0.32 | 9 | 3.5 |
| I | Monodisperse tabular grain with average aspect ratio of 7.0 | 0.80 | 28 | 1.5 |
| J | Monodisperse tetradecahedral grain | 0.30 | 18 | 4.0 |
| K | Monodisperse tabular grain with average aspect ratio of 7.0 | 0.45 | 17 | 4.0 |
| L | Monodisperse cubic internal latent image type grain | 0.46 | 14 | 3.5 |
| M | Monodisperse tabular grain with average aspect ratio of 7.0 | 0.55 | 13 | 4.0 |
| N | Monodisperse tabular grain with average aspect ratio of 7.0 | 1.00 | 33 | 1.3 |

TABLE 9

Spectral sensitization of Emulsions A to N

| Emulsion | Sensitizing dye added | Amount (g) added per mol of silver halide | Time of addition of sensitizing dye |
|---|---|---|---|
| A | S-1 | 0.025 | Shortly after chemical sensitization |
| | S-2 | 0.25 | Shortly after chemical sensitization |
| B | S-1 | 0.01 | Shortly after the completion of the formation of grain |
| | S-2 | 0.25 | Shortly after the completion of the formation of grain |
| C | S-1 | 0.02 | Shortly before the beginning of chemical sensitization |
| | S-2 | 0.25 | Shortly before the beginning of chemical sensitization |
| D | S-1 | 0.01 | Shortly after chemical sensitization |
| | S-2 | 0.10 | Shortly after chemical sensitization |
| | S-7 | 0.01 | Shortly after chemical sensitization |
| E | S-3 | 0.5 | Shortly after chemical sensitization |
| | S-4 | 0.1 | Shortly after chemical sensitization |
| F | S-3 | 0.3 | Shortly after chemical sensitization |
| | S-4 | 0.1 | Shortly after chemical sensitization |
| G | S-3 | 0.25 | Shortly after the completion of the formation of grain |
| | S-4 | 0.08 | Shortly after the completion of the formation of grain |
| H | S-3 | 0.2 | During the formation of grain |
| | S-4 | 0.06 | During the formation of grain |
| I | S-3 | 0.3 | Shortly before the beginning of chemical sensitization |

TABLE 9-continued

Spectral sensitization of Emulsions A to N

| Emulsion | Sensitizing dye added | Amount (g) added per mol of silver halide | Time of addition of sensitizing dye |
|---|---|---|---|
| | S-4 | 0.07 | Shortly before the beginning of chemical sensitization |
| | S-8 | 0.1 | Shortly before the beginning of chemical sensitization |
| J | S-6 | 0.2 | During the formation of grain |
| | S-5 | 0.05 | During the formation of grain |
| K | S-6 | 0.2 | Shortly before the beginning of chemical sensitization |
| | S-5 | 0.05 | Shortly before the beginning of chemical sensitization |
| L | S-6 | 0.22 | Shortly after the completion of the formation of grain |
| | S-5 | 0.06 | Shortly after the completion of the formation of grain |
| M | S-6 | 0.15 | Shortly before the beginning of chemical sensitization |
| | S-5 | 0.04 | Shortly before the beginning of chemical sensitization |
| N | S-6 | 0.22 | Shortly after the completion of the formation of grain |
| | S-5 | 0.06 | Shortly after the completion of the formation of grain |

The structural formulae of the compounds used for preparation of Sample 101 were as follows.

C-1

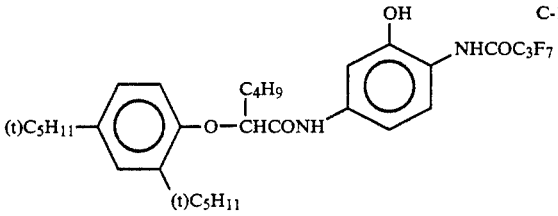

C-2

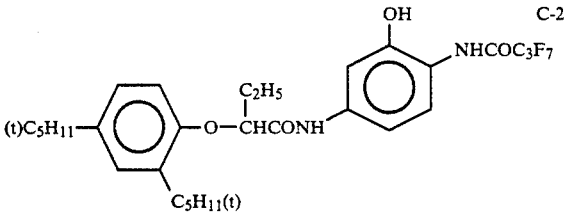

C-3

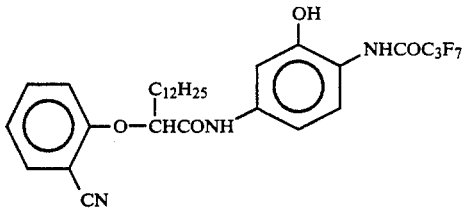

C-4

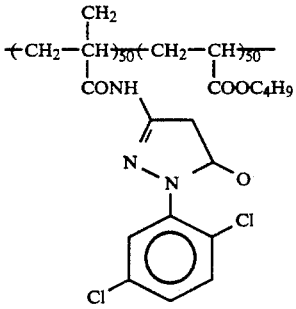

Figure indicates wt. % Average molecular weight: about 25,000

-continued

C-5

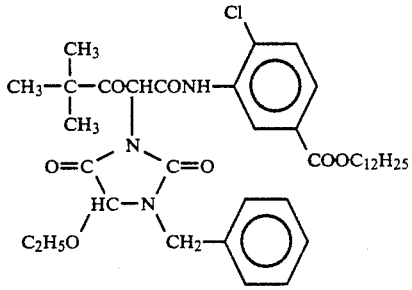

C-6

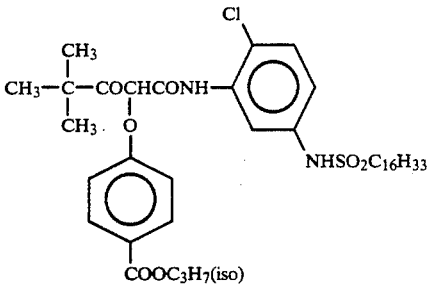

C-7

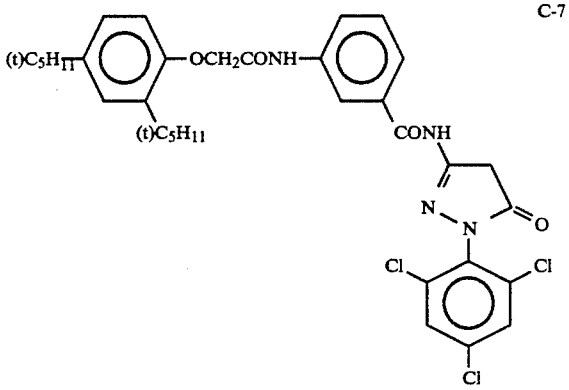

-continued
C-8
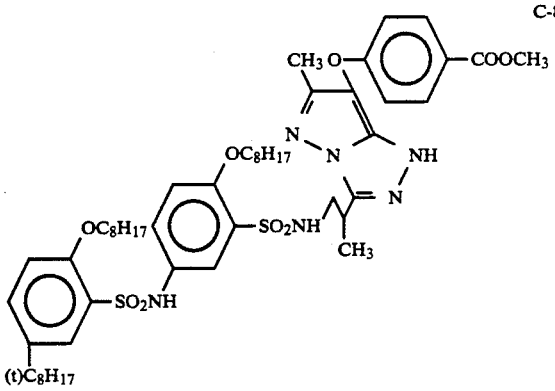
C-9
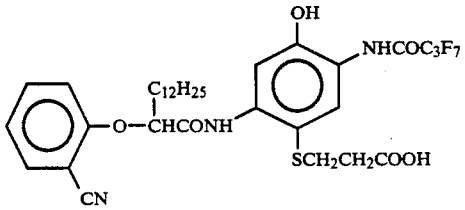
Oil-1: Dibutyl phthalate
Oil-2: Tricresyl phosphate
Oil-3
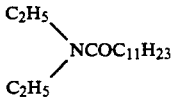
Cpd-A
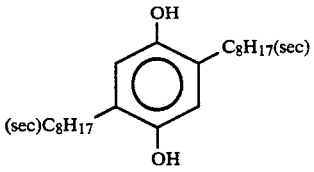
Cpd-B
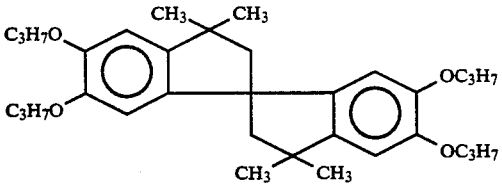
Cpd-C
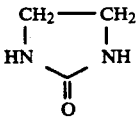
Cpd-D
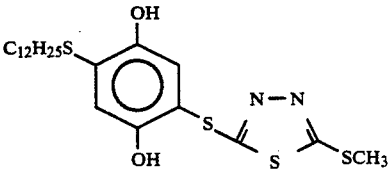
-continued
Cpd-E
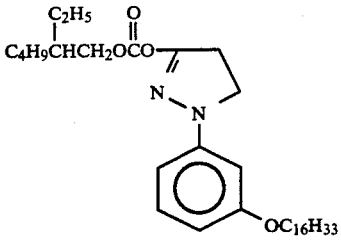
Cpd-F
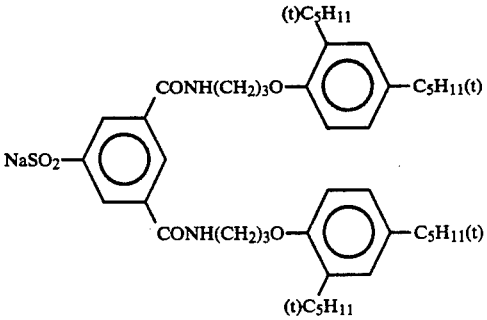
Cpd-G
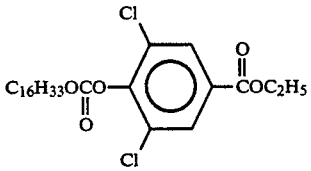
Cpd-H
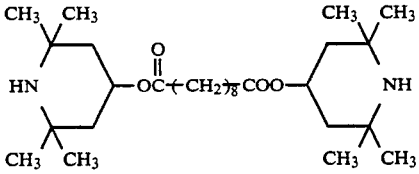
Cpd-I
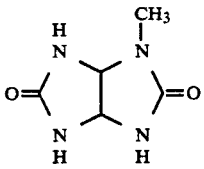
Cpd-K
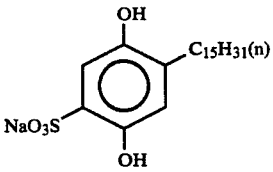
Cpd-L
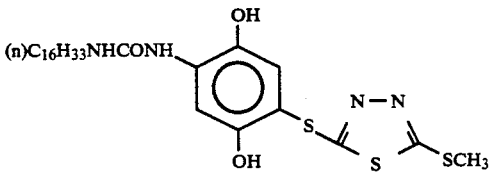

-continued
Cpd-M
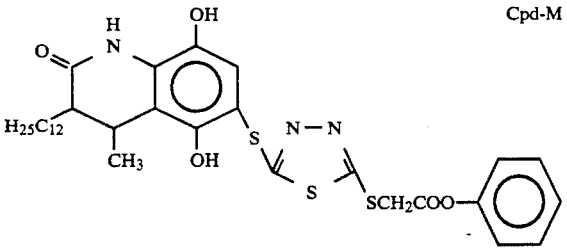
Cpd-N
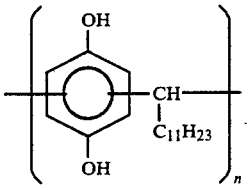
Average molecular weight: 9,000
U-1
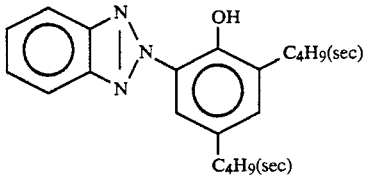
U-2
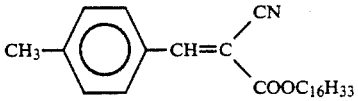
U-3
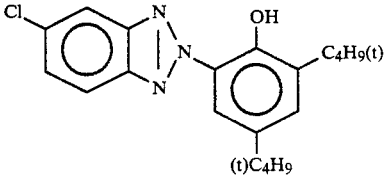
U-4
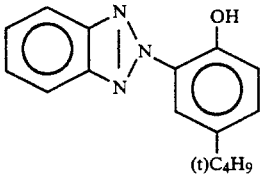
U-5
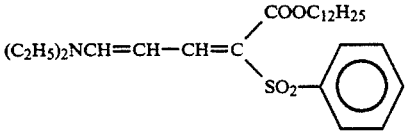
U-6
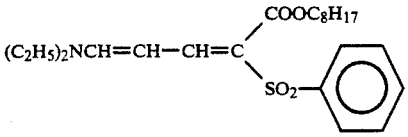
S-1
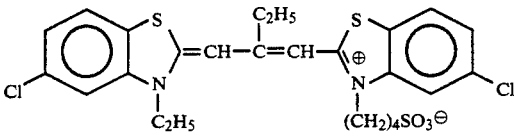
-continued
S-2
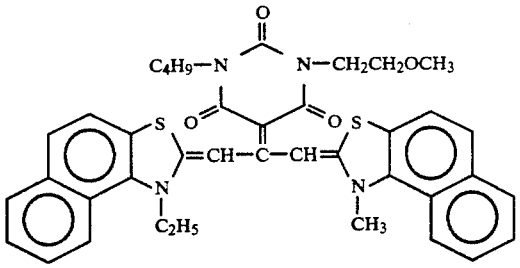
S-3
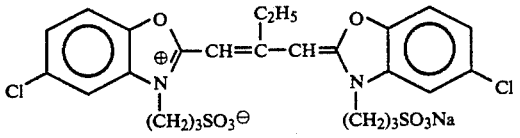
S-4
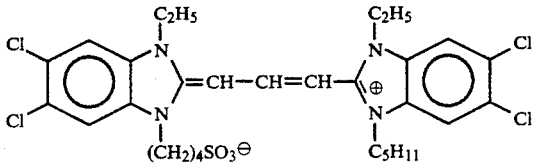
S-5
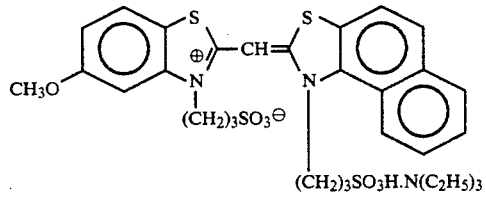
S-6
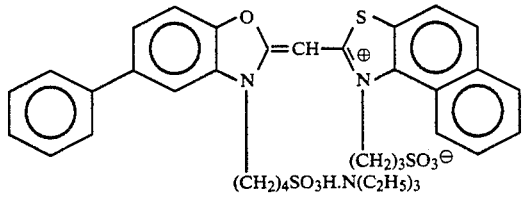
S-7
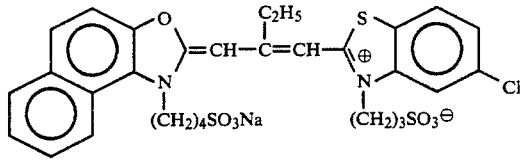
S-8
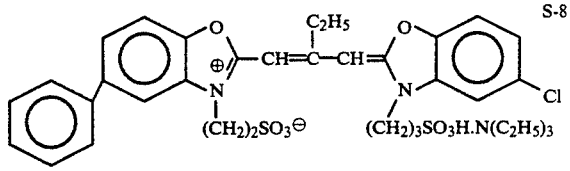
D-1
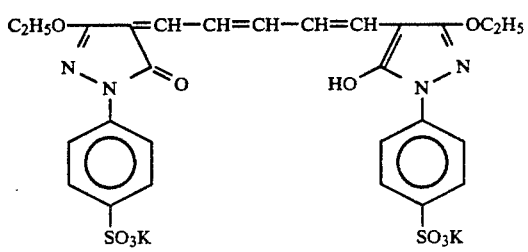

-continued
D-2
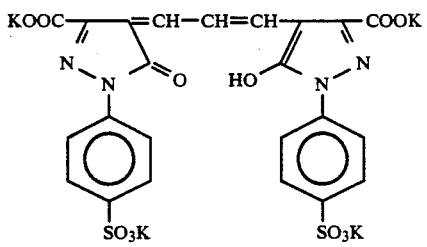
D-3
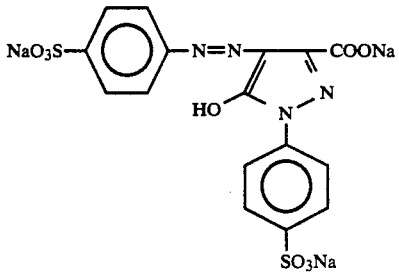
D-4
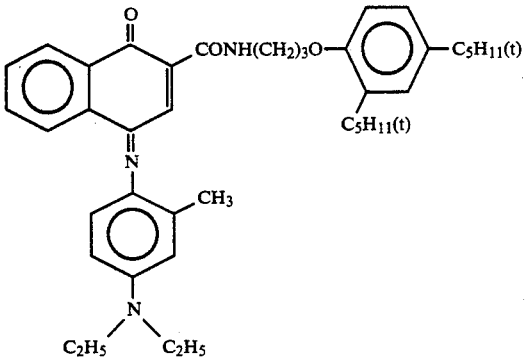
E-1
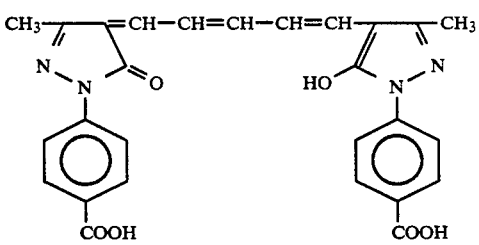
E-2
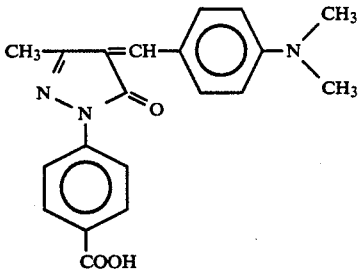
H-1
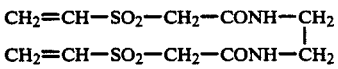
W-1
-continued
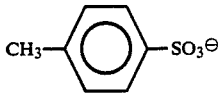
W-2
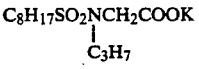
W-3
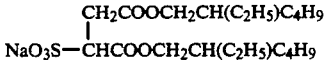
W-4
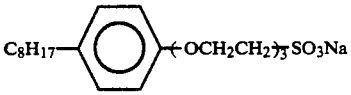
W-5
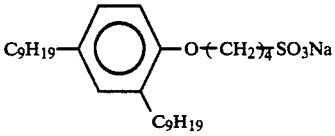
W-6
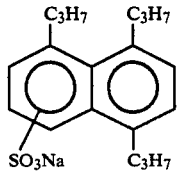
W-7
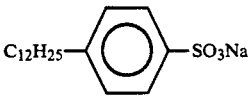
P-1
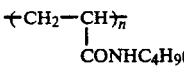
M-1
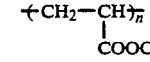
F-1
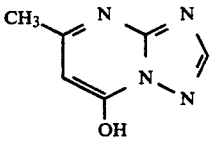
F-2
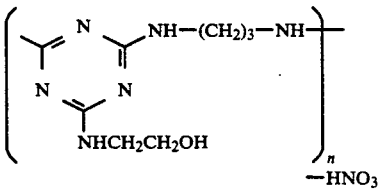
F-3
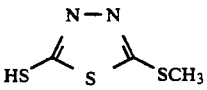

-continued

F-4

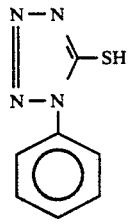

F-5

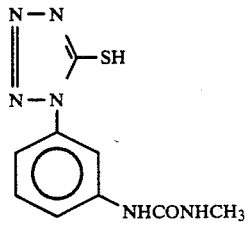

F-6

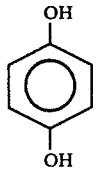

F-7

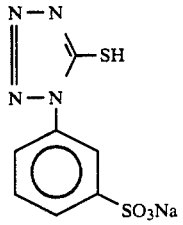

F-8

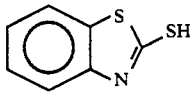

Comparative Compound A

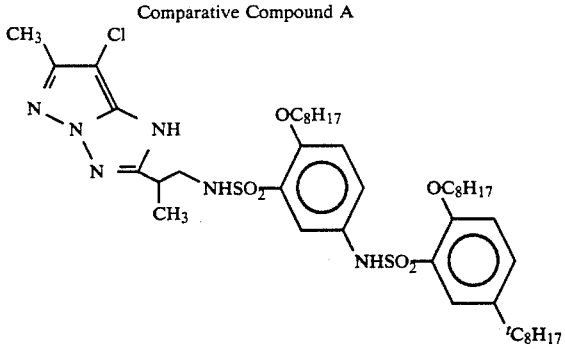

Preparaton of Samples 102 to 118

Samples 102 to 118 were prepared in the same manner as Sample 101 except that Couplers C-4, C-7, C-5 and C-6 to be incorporated in the 9th to 11th layers, and 15th to 17th layers were replaced by the comparative compounds and the present compounds as set forth in Table 10 in the equimolecular amount as the total molar amount of the couplers to be incorporated in these layers.

The couplers used are set forth in Table 10.

TABLE 10

| Sample | Magenta coupler incorporated in 9th and 10 layers | Yellow coupler incorporated in 15th to 17th layers |
|---|---|---|
| 101 (comparative) | C-4/C-7 | C-5/C-6 |
| 102 (comparative) | Comparative Compound A | " |
| 103 (comparative) | M-2 | " |
| 104 (comparative) | M-8 | " |
| 105 (comparative) | M-51 | " |
| 106 (comparative) | M-56 | " |
| 107 (comparative) | C-4/C-7 | Y-9 |
| 108 (comparative) | Comparative Compound A | " |
| 109 (present invention) | M-2 | " |
| 110 (present invention) | M-8 | " |
| 111 (present invention) | M-51 | " |
| 112 (present invention) | M-56 | " |
| 113 (comparative) | C-4/C-7 | Y-11 |
| 114 (comparative) | Comparative Compound A | " |
| 115 (present invention) | M-2 | " |
| 116 (present invention) | M-8 | " |
| 117 (present invention) | M-51 | " |
| 118 (present invention) | M-56 | " |

Samples 101 to 118 thus obtained were cut into strips by an ordinary method. These strips were exposed to white light. Another batch of these strips were exposed through a yellow filter. These samples were then subjected to the following development.

Thus, grey-colored strips and monochromatically yellow-colored strips were obtained.

These strips were stored at a temperature of 80° C. and a relative humidity of 70% for 3 weeks, and then measured for density to evaluate the yellow and magenta discoloration behavior and the degree of magenta stain on the yellow-colored portion under a high temperature and humidity condition.

TABLE 11

| Sample | Percentage magenta dye remaining[1] (%) | Percentage yellow dye remaining[2] (%) | Magenta density on yellow-colored portion[3] |
|---|---|---|---|
| 101 (comparative) | 83 | 75 | +0.01 |
| 102 (comparative) | 95 | 75 | +0.16 |
| 103 (comparative) | 96 | 74 | +0.03 |
| 104 (comparative) | 97 | 73 | +0.03 |
| 105 (comparative) | 96 | 74 | ±0.00 |
| 106 (comparative) | 97 | 74 | +0.01 |
| 107 (comparative) | 82 | 74 | +0.01 |
| 108 (comparative) | 96 | 75 | +0.15 |
| 109 (present invention) | 95 | 92 | +0.03 |

TABLE 11-continued

| Sample | Percentage magenta dye remaining[1)] (%) | Percentage yellow dye remaining[2)] (%) | Magenta density on yellow-colored portion[3)] |
|---|---|---|---|
| 110 (present invention) | 97 | 93 | +0.03 |
| 111 (present invention) | 97 | 93 | ±0 |
| 112 (present invention) | 97 | 93 | ±0 |
| 113 (comparative) | 83 | 92 | +0.01 |
| 114 (comparative) | 93 | 93 | +0.15 |
| 115 (present invention) | 94 | 94 | +0.03 |
| 116 (present invention) | 95 | 94 | +0.03 |
| 117 (present invention) | 97 | 93 | ±0 |
| 118 (present invention) | 96 | 93 | +0.01 |

1), 2): Percentage of dye remaining after storage at 80° C., 70% RH for 3 weeks (initial density: 2.0)
3): Rise in magenta density on the portion of a yellow color density of 2.0 after storage

| Processing step | | | | |
|---|---|---|---|---|
| Step | Time | Temp. | Tank capacity | Replenishment rate |
| Black-and-white development | 6 min. | 38° C. | 12 l | 2.2 l/m$^2$ |
| 1st rinse | 2 min. | 38° C. | 4 l | 7.5 l/m$^2$ |
| Reverse | 2 min. | 38° C. | 4 l | 1.1 l/m$^2$ |
| Color development | 6 min. | 38° C. | 12 l | 2.2 l/m$^2$ |
| Adjustment | 2 min. | 38° C. | 4 l | 1.1 l/m$^2$ |
| Bleach | 6 min. | 38° C. | 12 l | 0.22 l/m$^2$ |
| Fixing | 4 min. | 38° C. | 8 l | 1.1 l/m$^2$ |
| 2nd rinse | 4 min. | 38° C. | 8 l | 7.5 l/m$^2$ |
| Stabilization | 1 min. | 25° C. | 2 l | 1.1 l/m$^2$ |

The composition of the various processing solutions were as follows:

| | Running Solution | Replenisher |
|---|---|---|
| **Black-and-white developer** | | |
| Pentasodium nitrilo-N,N,N-trimethylenephosphonate | 2.0 g | 2.0 g |
| Sodium sulfite | 30 g | 30 g |
| Potassium hydroquinone monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1,000 ml | 1,000 ml |
| pH (adjusted with hydrochloric acid or potassium hydroxide) | 9.60 | 9.60 |
| **Reversing bath** | | |
| Pentasodium nitrilo-N,N,N-trimethylenephosphonate | 3.0 g | Same as left |
| Stannous chloride dihydrate | 1.0 g | Same as left |
| p-Aminophenol | 0.1 g | Same as left |
| Sodium hydroxide | 8 g | Same as left |
| Glacial acetic acid | 15 ml | Same as left |
| Water to make | 1,000 ml | Same as left |
| pH (adjusted with hydrochloric acid or sodium hydroxide) | 6.00 | Same as left |
| **Color developer** | | |
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-(β-methanesulfonamidoethyl)-3-methyl-4-aminoaniline sulfate | 11 g | 11 g |
| 3,6-Dithia-1,8-octanediol | 1.0 g | 1.0 g |
| Water to make | 1,000 ml | 1,000 ml |
| pH (adjusted with hydrochloric acid or potassium hydroxide) | 11.80 | 12.00 |
| **Adjusting solution** | | |
| Disodium ethylenediaminetetraacetate dihydrate | 8.0 g | Same as left |
| Sodium sulfite | 12 g | Same as left |
| 1-Thioglycerin | 0.4 ml | Same as left |
| Sorbitan ester | 0.1 g | Same as left |

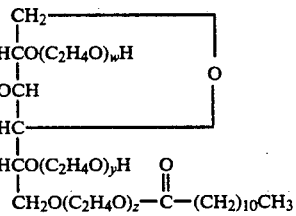

(w + x + y + z = 20)

| | Running Solution | Replenisher |
|---|---|---|
| Water to make | 1,000 ml | Same as left |
| pH (adjusted with hydrochloric acid or sodium hydroxide) | 6.20 | Same as left |
| **Bleaching solution** | | |
| Disodium ethylenediaminetetraacetate dihydrate | 2.0 g | 4.0 g |
| Ferric ammonium ethylenediaminetetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH (adjusted with hydrochloric acid or sodium hydroxide) | 5.70 | 5.50 |
| **Fixing solution** | | |
| Ammonium thiosulfate | 8.0 g | Same as left |
| Sodium sulfite | 5.0 g | Same as left |
| Sodium bisulfite | 5.0 g | Same as left |
| Water to make | 1,000 ml | Same as left |
| pH (adjusted with hydrochloric acid or aqueous ammonia) | 6.60 | Same as left |
| **Stabilizing solution** | | |
| 37% Formalin | 5.0 ml | Same as left |
| Polyoxyethylene-p-monononylphenylether (average polymerization degree: 10) | 0.5 ml | Same as left |
| Water to make | 1,000 ml | Same as left |
| pH | | not adjusted |

The results are set forth in Table 11.

Table 11 shows that the samples of the present invention exhibit an excellent magenta and yellow image fastness and a good balance between them. It can also been found that the examples of the present invention exhibit extremely little magenta stain in the monochromatically yellow-colored image.

EXAMPLE 2

Sample A is prepared in the same manner as Sample 201 in Example 2 of JP-A-2-90151 except that Coupler Cp-I to be incorporated in the 6th to 8th layers and Coupler Cp-L to be incorporated in the 10th and 11th layers are replaced by Coupler M-4 of the present invention and Coupler Y-7 of the present invention in the equimolecular amounts, respectively. Sample A thus obtained is subjected to the same processing as effected in Example 2 of JP-A-2-90151, and then subjected to the same test as effected in Example 1 of the present invention. Results similar to that of Example 1 of the present invention are obtained.

EXAMPLE 3

Sample B is prepared in the same manner as the color photographic light-sensitive material in Example 2 of JP-A-1-158431 except that Couplers EXM-11 and EXM-12 to be incorporated in the 6th and 7th layers are replaced by Coupler M-56 of the present invention in the equimolecular amount and Coupler EXY-1 to be incorporated in the 11th and 12th layers are replaced by Coupler Y-11 of the present invention in a molar amount of 0.7 times that of Coupler Y-11. Sample B thus obtained is subjected to the same processing as effected in Example 2 of JP-A-1-158431, and then subjected to the same dye fastness test as in the present invention. Results similar to that of Example 1 of the present invention are obtained.

EXAMPLE 4

Sample C is prepared in the same manner as Sample No. 1 in Example 1 of JP-A-2-90145 except that Couplers EXM-1, 2 and 3 to be incorporated in the 6th and 7th layers are replaced by Coupler M-13 of the present invention in the equimolecular amounts, respectively, and Couplers EXY-1 and 2 to be incorporated in the 11th and 12th layers are replaced by Coupler Y-37 of the present invention in a molar amount of 0.9 times that of Coupler Y-37, respectively. Sample C thus obtained is subjected to the same processing as effected in Example 1 of JP-A-2-90145, and then subjected to the same dye fastness test as in the present invention. Results similar to that of Example 1 of the present invention are obtained.

EXAMPLE 5

Sample D is prepared in the same manner as Sample 214 in Example 2 of JP-A-2-139544 except that the yellow coupler EXY and the magenta coupler EXM are replaced by Couplers Y-6 and M-52 of the present invention in the equimolecular amounts, respectively. Sample D thus obtained is subjected to the same processing as effected in Example 2 of JP-A-2-139544, and then subjected to the same dye fastness test as in the present invention. Results similar to that of Example 1 of the present invention are obtained.

In accordance with the present invention, a color light-sensitive material can be obtained which exhibits a good balance between the yellow and magenta dye discoloration, an improved dye preservability and a reduced magenta stain.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising on a support at least one blue-sensitive layer, one green-sensitive layer and one red-sensitive layer, wherein said blue-sensitive layer comprises at least one yellow dye-forming coupler selected from the group consisting of general formulae (1), (2) and combinations thereof and said green-sensitive layer comprises at least one magenta dye-forming coupler represented by the following general formula (M):

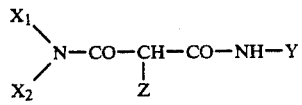
(1)

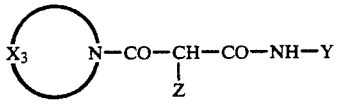
(2)

wherein $X_1$ and $X_2$ each represents an alkyl group, an aryl group or a heterocyclic group; $X_3$ represents an organic residue which forms a nitrogen-containing heterocyclic group together with >N—; Y represents an aryl group or a heterocyclic group; and Z represents a group which separates from the remainder of the molecule when the coupler undergoes a reaction with an oxidation product of a developing agent;

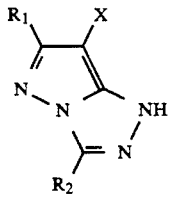
(M)

wherein $R_1$ and $R_2$ each represents a hydrogen atom or a substituent; and X represents a hydrogen atom or a group which separates from the remainder of the molecule when the coupler undergoes a reaction with an oxidation product of a developing agent.

2. The silver halide color photographic material as claimed in claim 1, wherein said couplers represented by the general formulae (1) and (2) are compounds represented by the following general formulae (3), (4) or (5):

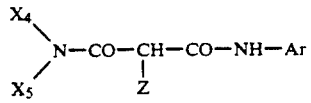
(3)

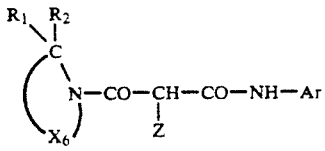
(4)

-continued

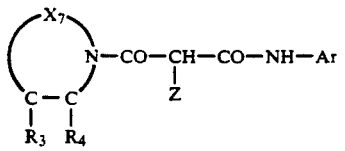

(5)

wherein Z is as defined in the general formula (1); $X_4$ represents an alkyl group; $X_5$ represents an alkyl group or an aromatic group; Ar represents a phenyl group containing at least one substituent in the ortho position thereof; $X_6$ represents an organic residue which forms a nitrogen-containing heterocyclic group (monocyclic or condensed) together with —C($R_1R_2$)—N<; $X_7$ represents an organic residue which forms a nitrogen-containing heterocyclic group (monocyclic or condensed) together with —C($R_3$)=C($R_4$)—N<; and $R_1$, $R_2$, $R_3$ and $R_4$ each represents a hydrogen atom or a substituent.

3. The silver halide color photographic material as claimed in claim 2, wherein said couplers represented by the general formulae (1) to (5) are nondiffusive couplers.

4. The silver halide color photographic material as claimed in claim 1, wherein the alkyl group represented by $X_1$ or $X_2$ in the general formula (1) is a $C_{1-30}$, straight-chain, branched or cyclic, saturated or unsaturated, substituted or unsubstituted alkyl group.

5. The silver halide color photographic material as claimed in claim 1, wherein the heterocyclic group represented by $X_1$ or $X_2$ in the general formula (1) is a $C_{1-20}$, 3- to 12-membered, saturated or unsaturated, substituted or unsubstituted, monocyclic or condensed heterocyclic group containing at least one nitrogen atom, oxygen atom or sulfur atom as a hetero atom.

6. The silver halide color photographic material as claimed in claim 1, wherein the aryl group represented by $X_1$, $X_2$ or Y in the general formulae (1) and (2) is a $C_{6-20}$, substituted or unsubstituted aryl group.

7. The silver halide color photographic material as claimed in claim 1, wherein the nitrogen-containing heterocyclic group formed by $X_3$ in the general formula (2) together with >N— is a $C_{1-20}$, 3- to 12-membered, substituted or unsubstituted, saturated or unsaturated, monocyclic or condensed heterocyclic group which may contain an oxygen atom or a sulfur atom in addition to a nitrogen atom as a hetero atom.

8. The silver halide color photographic material as claimed in claim 1, wherein $X_1$ and $X_2$ in the general formula (1) each represents a substituted alkyl, aryl or heterocyclic group and $X_3$ in the general formula (2) forms a substituted nitrogen-containing heterocyclic group together with >N—, said substituents being selected from the group consisting of an alkoxy group, a halogen atom, an alkoxycarbonyl group, an acyloxy group, an acrylamino group, a sulfonyl group, a carbamoyl group, a sulfamoyl group, a sulfonamide group, a nitro group, an alkyl group, and an aryl group.

9. The silver halide color photographic material as claimed in claim 1, wherein the aryl group represented by Y in the general formulae (1) and (2) is a $C_{6-20}$, substituted or unsubstituted aryl group.

10. The silver halide color photographic material as claimed in claim 9, wherein Y is a phenyl group containing at least one substituent in the ortho position.

11. The silver halide color photographic material as claimed in claim 1, wherein the group represented by $X_1$ in the general formula (1) is a $C_{1-10}$ alkyl group.

12. The silver halide color photographic material as claimed in claim 1, wherein the group represented by Z in the general formulae (1) to (5) is a 5- or 6-membered nitrogen-containing heterocyclic group which is bonded to the coupling position via the nitrogen atom, an aromatic oxy group, a 5- or 6-membered heterocyclic oxy group or a 5- or 6-membered heterocyclic thio group.

13. The silver halide color photographic material as claimed in claim 2, wherein the couplers represented by the general formulae (3), (4) or (5) are those represented by the general formulae (4) or (5).

14. The silver halide color photographic material as claimed in claim 2, wherein the couplers represented by the general formulae (1) to (5) may form a dimer or higher polymer connected via a group having a valency of 2 or more to the group represented by $X_1$ to $X_7$, Y, Ar, $R_1$ to $R_4$, or Z.

15. The Silver halide color photographic material as claimed in claim 1, wherein $R_1$ in the general formula (M) represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imide group, a heterocyclic thio group, a sulfinyl group, a phosphonyl group, an aryloxycarbonyl group, an acyl group, an azolyl group a urethane group or a divalent group which forms a bis-form unit.

16. The silver halide color photographic material as claimed in claim 1, wherein $R_1$ in the general formula (M) represents an alkyl group, an aryl group, an alkoxy group, an aryloxy group, an alkylthio group, a ureido group, a urethane group, or an acylamino group.

17. The silver halide color photographic material as claimed in claim 1, wherein $R_2$ in the general formula (M) represents a hydrogen atom, an alkyl group, an aryl group, a heterocyclic group, an alkoxy group, an aryloxy group, an alkylthio group, an arylthio group, an alkoxycarbonyl group, a carbamoyl group or an acyl group.

18. The silver halide color photographic material as claimed in claim 1, wherein X in the general formula (M) represents a hydrogen atom, a halogen atom, an alkoxy group, an aryloxy group, an acyloxy group, an alkylsulfonyloxy group, an arylsulfonyloxy group, an acylamino group, an alkylsulfonamide group, an arylsulfonamide group, an alkoxycarbonyloxy group, an aryloxycarbonyloxy group, an alkylthio group, an arylthio group, a heterocyclic thio group, a carbamoylamino group, 5- or 6-membered nitrogen-containing heterocyclic group, an imide group or an arylazo group.

19. The silver halide color photographic material as claimed in claim 1, wherein the amount of the coupler represented by the general formula (M) to be incorporated in the green-sensitive emulsion layer or in the light-insensitive interlayer is in the range of 0.001 to 2 mol, per mol of silver in the green-sensitive emulsion layer.

20. The silver halide color photographic material as claimed in claim 1, wherein the yellow couplers represented by the general formulae (1) to (5) are present in an amount of 1.0 to $1.0\times10^{-3}$ mol, per mol of silver halide.

21. A silver halide color photographic material comprising on a support at least one blue-sensitive layer, one green-sensitive layer and one red-sensitive layer, wherein said blue-sensitive layer comprises at last one yellow dye-forming coupler of general formula (1) and said green-sensitive layer comprises at last one magenta dye-forming coupler represented by the following general formula (M):

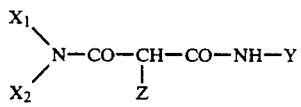

(1)

wherein $X_1$ and $X_2$ each represents an alkyl group, an aryl group or a heterocyclic group; Y represents an aryl group or a heterocyclic group; and Z represents a group which separates from the remainder of the molecule when the coupler undergoes a reaction with an oxidation product of a developing agent;

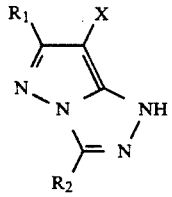

(M)

wherein $R_1$ and $R_2$ each represents a hydrogen atom or a substituent; and X represents a hydrogen atom or a group which separates from the remainder of the molecule when the coupler undergoes a reaction with an oxidation product of a developing agent.

22. A silver halide color photographic material comprising on a support at least one blue-sensitive layer, one green-sensitive layer and one red-sensitive layer, wherein said blue-sensitive layer comprises at least one yellow dye-forming coupler of general formula (2) and said green-sensitive layer comprises at least one magenta dye-forming coupler represented by the following general formula (M):

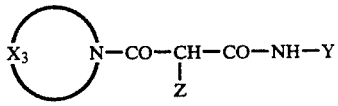

(2)

wherein $X_3$ represents an organic residue which forms a nitrogen-containing heterocyclic group together with <N—; Y represents an aryl group of a heterocyclic group; and Z represents a group which separates from the remainder of the molecule when the coupler undergoes a reaction with an oxidation product of a developing agent;

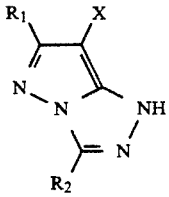

(M)

wherein $R_1$ and $R_2$ each represents a hydrogen atom or a substituent; and X represents an hydrogen atom or a group which separates from the remainder of the molecule when the coupler undergoes a reaction with an oxidation product of a developing agent.

* * * * *